US009916785B2

(12) United States Patent
Santo

(10) Patent No.: US 9,916,785 B2
(45) Date of Patent: Mar. 13, 2018

(54) DISPLAY APPARATUS AND CONTROL METHOD THEREOF, LIGHT EMITTING APPARATUS AND CONTROL METHOD THEREOF, AND NON-TRANSITORY COMPUTER READABLE STORAGE MEDIUM

(71) Applicant: CANON KABUSHIKI KAISHA, Tokyo (JP)

(72) Inventor: Hideki Santo, Kodaira (JP)

(73) Assignee: Canon Kabushiki Kaisha, Tokyo (JP)

( * ) Notice: Subject to any disclaimer, the term of this patent is extended or adjusted under 35 U.S.C. 154(b) by 566 days.

(21) Appl. No.: 14/538,318

(22) Filed: Nov. 11, 2014

(65) Prior Publication Data

US 2015/0130863 A1 May 14, 2015

(30) Foreign Application Priority Data

Nov. 13, 2013 (JP) ..... 2013-234815

(51) Int. Cl.

| | |
|---|---|
| ***G09G 5/10*** | (2006.01) |
| ***G09G 3/20*** | (2006.01) |
| ***G09G 3/3208*** | (2016.01) |
| ***G09G 3/32*** | (2016.01) |
| ***G09G 3/34*** | (2006.01) |

(52) U.S. Cl.

CPC ..... *G09G 3/2003* (2013.01); *G09G 3/32* (2013.01); *G09G 3/3208* (2013.01); *G09G 3/3413* (2013.01); *G09G 2320/0242* (2013.01); *G09G 2320/043* (2013.01); *G09G 2320/045* (2013.01); *G09G 2320/048* (2013.01); *G09G 2320/0606* (2013.01); *G09G 2320/0666* (2013.01)

(58) Field of Classification Search

USPC ..... 345/691

See application file for complete search history.

(56) References Cited

U.S. PATENT DOCUMENTS

| | | | |
|---|---|---|---|
| 2005/0062691 | A1 | 3/2005 | Tamura |
| 2005/0243108 | A1 | 11/2005 | Kim |
| 2007/0120808 | A1 | 5/2007 | Shimoda |
| 2010/0277410 | A1 | 11/2010 | You |

FOREIGN PATENT DOCUMENTS

| | | | |
|---|---|---|---|
| CN | 1870120 | A | 11/2006 |
| CN | 101174386 | A | 5/2008 |
| CN | 101222799 | A | 7/2008 |
| CN | 101392875 | A | 3/2009 |
| CN | 202058422 | U | 11/2011 |
| EP | 1469449 | A1 | 10/2004 |
| JP | 2012-078842 | A | 4/2012 |
| KR | 10-2010-0029856 | A | 3/2010 |
| KR | 10-2012-0006953 | A | 1/2012 |
| RU | 2479000 | C2 | 4/2013 |

*Primary Examiner* — Gustavo Polo

(74) *Attorney, Agent, or Firm* — Canon USA, Inc. I.P. Division

(57) ABSTRACT

A storage unit stores first adjustment information which characterizes the correspondence between adjustment parameters which are capable of being set and adjustment amounts of the emission brightness of each of two light emitting elements of the three light emitting elements. A setting unit sets the adjustment parameter. An adjustment unit adjusts the emission brightness of the two light emitting elements based on the adjustment parameter set via the setting unit and the first adjustment information stored by the storage unit.

18 Claims, 17 Drawing Sheets

DISPLAY APPARATUS AND CONTROL METHOD THEREOF, LIGHT EMITTING APPARATUS AND CONTROL METHOD THEREOF, AND NON-TRANSITORY COMPUTER READABLE STORAGE MEDIUM

BACKGROUND

Field

The present disclosure relates to an apparatus and method for displaying an image and an apparatus and method for emitting light.

Description of the Related Art

These days, liquid crystal display apparatuses which use liquid crystal elements as display elements are widely deployed. However, a self-emitting type display apparatus which uses light emitting elements as display elements is being developed. For example, an LED (Light-Emitting Diode) or an organic EL (Electro Luminescence) element is used as the light emitting element. In a self-emitting type display apparatus, light emitting elements other than display elements are not necessary. In a self-emitting type display apparatus, the thickness of the display apparatus can be reduced in comparison with a liquid crystal display apparatus because a backlight unit, which is used in liquid crystal display apparatus, is not necessary. A self-emitting type organic EL display apparatus which uses organic EL elements has advantages including wide viewing angle and high response speed, etc. Therefore, it is expected that an organic EL display apparatus will become the main flat-panel display apparatus of the next generation of professional displays. In a self-emitting type display apparatus which can display color images, a light emitting element group composed of three light emitting elements, each having a different emission color, is used for each pixel. For example, the three light emitting elements consist of a red (R) element which emits red light, a green (G) element which emits green light, and a blue (B) element which emits blue light. In a self-emitting type display apparatus which can display color images, the color of each pixel (emission color of each light emitting element group) is adjustable by adjusting the ratio of the emission brightness of the three light emitting elements.

In a self-emitting type display apparatus, it is known that the emission brightness of the display elements changes based on elapsed time. Temporal changes in emission brightness occur due to temporal changes such as changes in I (electric current)–V (voltage) characteristics of the display elements. The electric current value, which passes through a driving transistor mounted on a pixel circuit for driving a display element (light emitting element), changes because the I–V characteristics of the display element changes. Then, the electric current value which passes through the display element changes because the electric current value which passes through the driving transistor changes. Consequently, the emission brightness of the display element changes because the electric current value which passes through the display element changes.

Generally, the three light emitting elements of a light emitting element group have different degrees of temporal change of emission brightness. Thus, the emission color of each light emitting element group changes based on elapsed time because of temporal change s of the emission brightness of display elements.

FIG. 16 depicts an example of the temporal change of the emission brightness of a R element, a G element, and a B element, each of which is an organic EL element. As described in FIG. 16, the temporal change speed of the emission brightness of the B element is the fastest, and the temporal change speed of the emission brightness of the G element is the slowest. Thus, in association with increased driving time (energization time) of a light emitting element group, the ratio of the emission brightness of the R element, the G element and the B element changes based on elapsed time. For example, even if the ratio of the emission brightness of the R element, the G element, and the B element is 1:1:1 in an initial state, the ratio of the emission brightness changes to 0.9:1:0.6 based on elapsed time in association with an increased driving time of the light emitting element group. Then, the emission color of the light emitting element group changes based on elapsed time because the ratio of the emission brightness changes based on elapsed time. For example, the emission color of the light emitting element group shifts toward green in comparison with the emission color in the initial state, because the temporal change speed of the emission brightness of the G element is the slowest among the R element, the G element, and the B element.

The above-described temporal changes of the emission color occurs not only in self-emitting type display apparatus but also in light emitting apparatus such as a backlight of a liquid crystal display, street lamp, and room light, etc.

For example, a manufacture's instruction manual "CANON HD Video Camera XA20/XA25, p. 148, 150" discloses adjustment technology for the emission color of organic EL light emitting element groups each of which consists of a R element, a G element, and a B element. FIG. 17 depicts an example parameter adjustment image of the prior reference. As described in FIG. 17, the emission color of light emitting element groups is adjusted by a user operation on a graphic operation image. Specifically, the graphic operation image described in FIG. 17 includes a R-operation-bar operable by a user and a B-operation-bar operable by a user. The emission brightness of the R elements is adjusted corresponding to a user's operation of the R-operation-bar, and the emission brightness of the B elements is adjusted corresponding to a user's operation of the B-operation-bar, causing the emission color of light emitting element groups to be adjusted. Thus, temporal changes of the emission color can be suppressed by adjusting the emission color of the light emitting element groups.

However, it is difficult to realize the intended emission color because the emission brightness of R elements and the emission brightness of B elements are adjusted individually in the above described technology. Specifically, because thousands of combinations of emission brightness of R elements and B elements exists, it is difficult to find a best combination of emission brightnesses of the R elements and the B elements to realize an intended emission color. It is also very difficult for users who are not familiar with color adjustment to operate two operation-bars to realize an intended emission color.

The present invention provides technology that enables easy adjustment of the emission color of light emitting element groups to an intended emission color.

SUMMARY

According to one aspect of the present subject matter, a display apparatus includes a light emitting element group composed of three light emitting elements each having a different emission color, a storage unit configured to store first adjustment information which characterizes the correspondence between adjustment parameters which are capable of being set and adjustment amounts of the emission brightness of each of two light emitting elements of the three light emitting elements, a setting unit configured to set the adjustment parameter, and an adjustment unit configured to adjust the emission brightness of the two light emitting elements based on the adjustment parameter set via the setting unit and the first adjustment information stored by the storage unit.

According to another aspect of the present subject matter, a light emitting apparatus includes a light emitting element group composed of three light emitting elements each having a different emission color, a storage unit configured to store first adjustment information which characterizes the correspondence between adjustment parameters which are capable of being set and adjustment amounts of the emission brightness of each of two light emitting elements of the three light emitting elements, a setting unit configured to set the adjustment parameter, and an adjustment unit configured to adjust the emission brightness of the two light emitting elements based on the adjustment parameter set via the setting unit and the first adjustment information stored by the storage unit.

Further features of the present subject matter will become apparent from the following description of exemplary embodiments (with reference to the attached drawings).

DETAILED DESCRIPTION

A self-emitting type display apparatus which uses light emitting elements as display elements is described below. However, the apparatus according to the present invention is not limited to such a self-emitting type display apparatus. For example, a light emitting apparatus such as backlighting of liquid crystal display, street lamp, and room light may alternatively be used.

(Structure)

The structure of the self-emitting type display apparatus according to the first example of the display apparatus is explained as follows.

Figure 1:
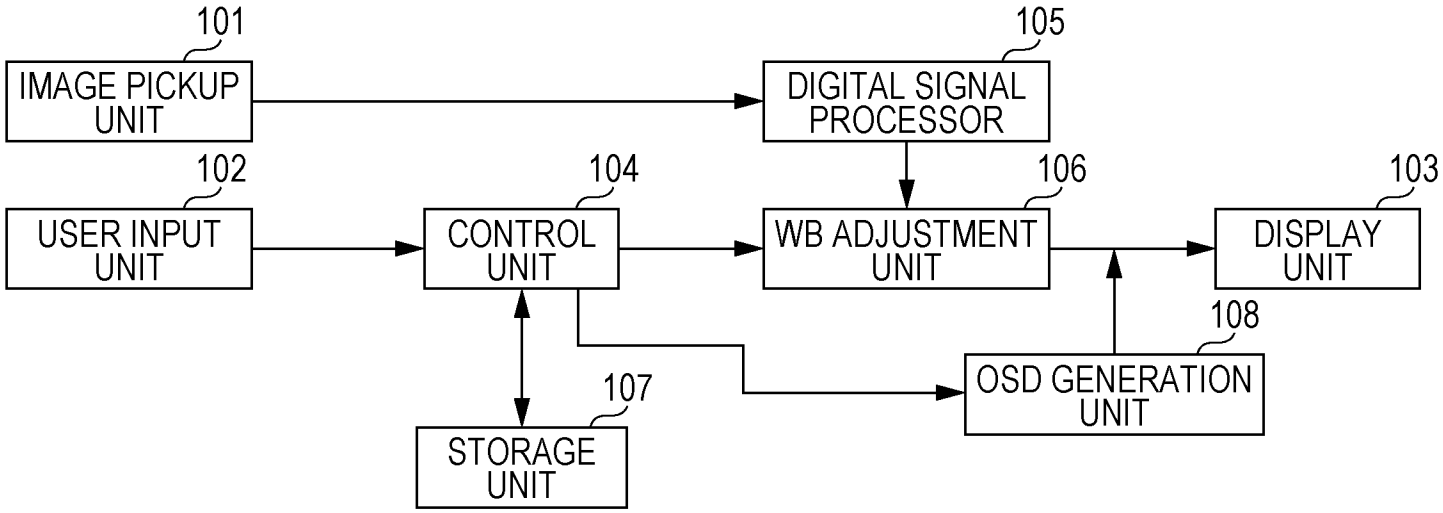
FIG. 1 is an example block diagram that depicts a display apparatus according to the first example of the display apparatus.

FIG. 1 is an example block diagram that depicts a display apparatus 100 according to the first example of the display apparatus.

A display unit 103 has a plurality of light emitting element group as a plurality of pixels. Display unit 103 displays an image by the lights emitted from the plurality of light emitting element group. Specifically, display unit 103 drives each light emitting element group by using a drive signal corresponding to a pixel value (value of image data). Each light emitting element group emits light corresponding to the driving signal. In other words, each light emitting element group emits light corresponding to the pixel value. Each light emitting element group is composed of three light emitting elements (sub pixels) each having a different emission color. The pixel value includes three sub-pixel values corresponding to three light emitting elements (a first light emitting element, a second light emitting element, and a third light emitting element) of a light emitting element group. Each light emitting element is driven based on corresponding sub-pixel values. For example, an LED (Light-Emitting Diode), an organic EL (Electro Luminescence) element, or a plasma element is used as the light emitting element.

In this example of the display apparatus, each light emitting element group is composed of a R element (first element), a G element (second element), and a B element (third element). Image data include a R value which is a sub-pixel value corresponding to a R element, a G value which is a sub-pixel value corresponding to a G element, and a B value which is a sub-pixel value corresponding to a B element.

The emission color of each light emitting element group is not limited to red, green, and blue. For example, each light emitting element group may include a Y element which emits yellow light.

The shape and layout of each light emitting element is not limited to a specific shape and layout.

The adjustment ratio of two light emitting elements (adjustment elements) among the three light emitting elements is stored in a storage unit 107 in advance. The adjustment ratio is the ratio of the adjustment amount of sub-pixel values of the two adjustment elements (first light emitting element and second emitting element). Specifically, the adjustment ratios are predetermined such that the color adjustment amount of the light emitted from a light emitting element group matches the temporal change amount of the emission color of the light emitted from the light emitting element group. The emission brightness of the light emitting element is adjusted when the sub-pixel value of the light emitting element is adjusted. Thus, in other words, the adjustment ratio is the ratio of the adjustment amount of emission brightness of the two adjustment elements. For example, a flash memory, a semiconductor memory, magnetic disc, or optical disc may be used as the storage unit 107.

In this example of the display apparatus, the two adjustment elements are a R element and a B element. First adjustment information including the adjustment ratio is stored in the storage unit 107 in advance. The first adjustment information (function or data table) indicates correspondence between adjustment parameters to be designated by a user and adjustment amounts of sub-pixel values of the two adjustment elements. In other words, the first adjustment information indicates correspondence between adjustment parameters to be designated by a user and adjustment amounts of emission brightness of the two adjustment elements. Only one kind of adjustment parameter is used in a process to adjust the sub-pixel values (emission brightness) of the two adjustment elements simultaneously.

The two adjustment elements are not limited to a R element and a B element. For example, the two adjustment elements may be a R element and a G element. The two adjustment elements may be a G element and a B element. In other words, a R element may be the second light emitting element or the third light emitting element. And, a B element may be the first light emitting element or the third light emitting element.

An image pick up unit 101 includes an imaging sensor that converts an optical image to an electrical signal (analog signal). For example, a CCD (Charge Coupled Device) element or a CMOS (Complementary Metal Oxide Semiconductor) element may be used as the imaging sensor. The image pickup unit 101 outputs the analog signal to a digital signal processor 105.

The digital signal processor 105 converts the analog signal outputted from the image pickup unit 101 to a digital signal. The digital signal processor 105 outputs the digital data which is image data to a WB (White Balance) adjustment unit 106.

The WB adjustment unit 106 performs a color adjustment process to the image data outputted from the digital signal processor 105. In the color adjustment process, sub-pixel values of the two adjustment elements are adjusted using the adjustment ratio stored in the storage unit 107. Thus, emission brightness of the two adjustment elements are adjusted using the adjustment ratio stored in the storage unit 107, and the emission color of the light emitting element group is adjusted.

In this example of the display apparatus, sub-pixel values of the two adjustment elements are adjusted using the adjustment amount corresponding to the adjustment parameter in the first adjustment information. In other words, the emission brightness of the two adjustment elements is adjusted using the adjustment amount corresponding to the adjustment parameter in the first adjustment information.

An adjustment parameter is set by an OSD (On-Screen Display) generation unit 108, an operation unit 102, and a control unit 104 in accordance with user's instruction. An adjustment parameter designated by the user is used in the color adjustment process.

The OSD generation unit 108 generates a graphic image and outputs the generated graphic image to the display unit 103. Thus, a graphic image based on a graphic image data generated by the OSD generation unit 108 is displayed on a screen. In a case where an image data is outputted from the WB adjustment unit 106, a combined image, which includes the graphic image and an image based on the image data outputted from the WB adjustment unit 106, is displayed on the screen.

In this example of the display apparatus, an OSD generation unit 108 generates a parameter adjustment image having a user input area operable by a user to designate an adjustment parameter.

The graphic image is not limited to the parameter adjustment image. For example, the graphic image may be an image having an operation area operable by a user to designate an operation mode of the display apparatus, or an image indicating information such as a brightness histogram outputted from the WB adjustment unit 106.

The operation unit 102 outputs operation information indicating a user's instruction to the control unit 104.

The control unit 104 performs a process corresponding to the operation information outputted from the operation unit 102. For example, the control unit 104 outputs display command for displaying the graphic image to the OSD generation unit 108 in accordance with user's instruction to display the graphic image. The OSD generation unit 108 generates graphic image data based on the display command outputted from the control unit 104, and output the generated graphic image data to the WB adjustment unit 106. The control unit 104 also sets an adjustment parameter in accordance with user's instruction, and determines the adjustment amount of sub-pixel values of the two adjustment elements. In other words, the control unit 104 determines the adjustment amount of emission brightness of the two adjustment elements. Specifically, the control unit 104 determines the adjustment amount corresponding to the set adjustment parameter based on the first adjustment information, and outputs the determined adjustment amount to the WB adjustment unit 106. The WB adjustment unit 106 performs the color adjustment process using the outputted adjustment amount of emission brightness of the two adjustment elements.

In this example of the display apparatus, operation unit 102 includes a menu button, up button, down button, left button, right button, and SET button, etc. For example, in accordance with the pressing of the menu button by a user, a graphic image for various settings is displayed on the screen. Then, various settings are performed in accordance with the pressing of the up button, down button, left button, right button, and SET button by the user.

Alternatively, the operation unit 102 may include a touch panel instead of the physical operation buttons. For example, a resistance film type touch panel, an electro static capacity type touch panel, a surface acoustic wave type touch panel, infrared type touch panel, an electromagnetic induction type touch panel, an image recognition type touch panel, or optical sensor type touch panel may be used.

The process for setting the adjustment parameter, and the process for determining the adjustment amount of emission brightness of the two adjustment elements may be performed by a function unit other than the control unit 104. The display apparatus may have a setting unit for setting the adjustment parameter, or determining unit for determining the adjustment amount of emission brightness of the two adjustment elements.

(Determining Process of the First Adjustment Information)

The method for determining the first adjustment information is explained as follows.

Figure 5:
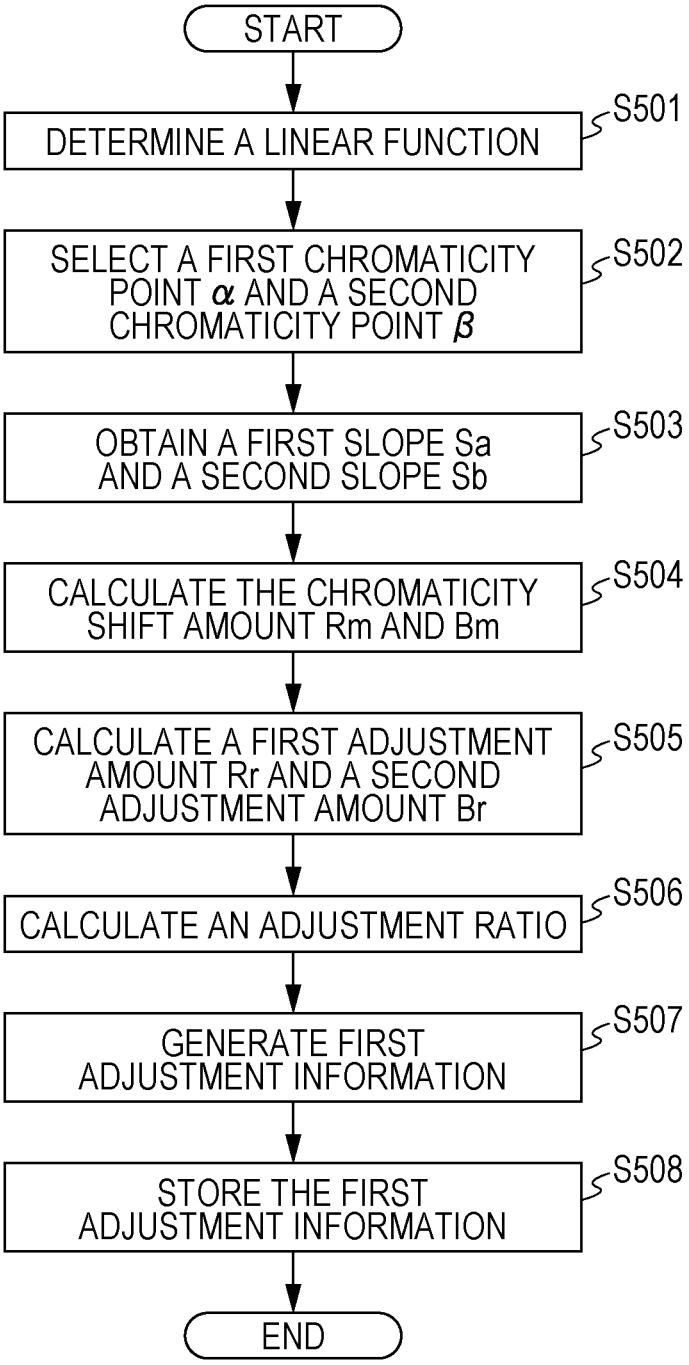
FIG. 5 is an example flowchart of a method for determining the first adjustment information.

FIG. 5 is an example flowchart of a method for determining the first adjustment information.

In S501, a linear function corresponding to the temporal changes of the emission color of the light emitted from a light emitting element group is determined. Specifically, a predetermined image is displayed on a screen, and the temporal changes of the emission color of the light emitted from the light emitting element group is measured using color sensor, etc. For example, the predetermined image is a white image based on image data having three maximum sub-pixel values of three sub-pixels composing each pixel.

Figure 2:
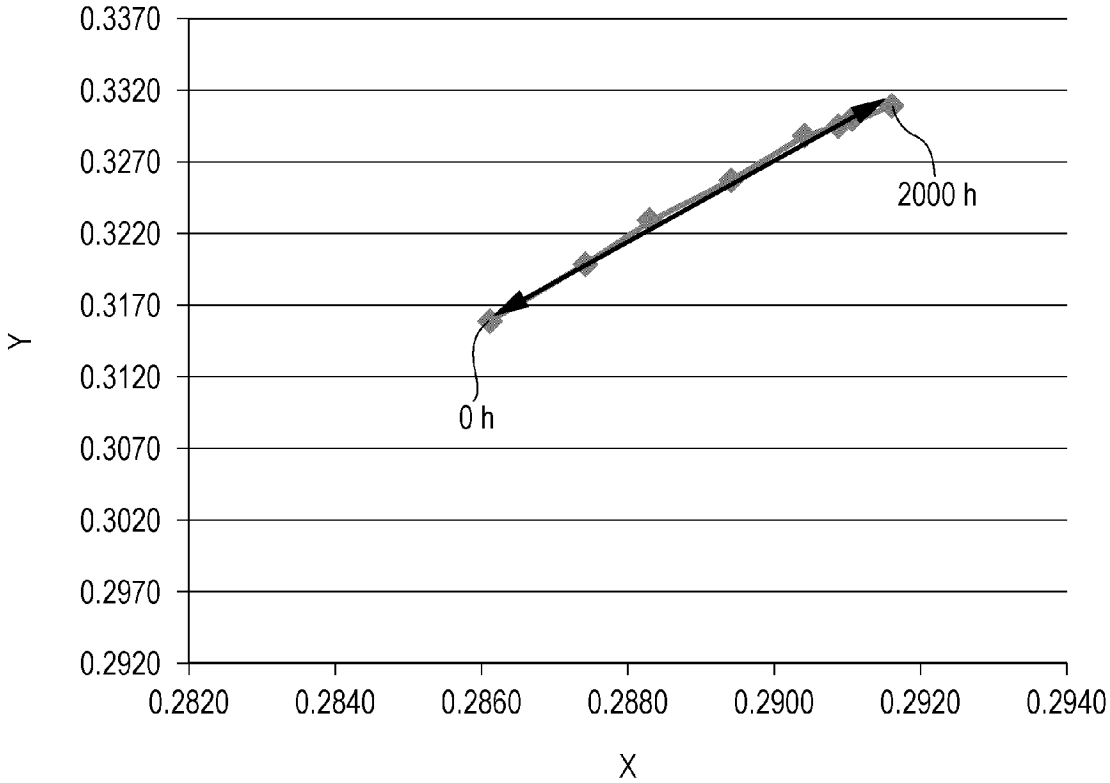
FIG. 2 depicts an example of an XY chromaticity diagram of a measurement result.

FIG. 2 depicts an example of a XY chromaticity diagram of a measurement result. In FIG. 2, each rectangular point indicates measured value of chromaticity. The leftmost rectangular point indicates the chromaticity point where the driving time is zero. The rightmost rectangular point indicates the chromaticity point where the driving time is 2000 hours. In S501, the linear function corresponding to the linear line with the arrows is calculated. Specifically, the linear function having X values and Y values as variables pass the chromaticity point when the driving time is zero and the chromaticity point when the driving time is 2000 hours in this example.

The predetermined image is not limited to the white image. For example, the image data of the predetermined image may have three sub-pixel values each of which is lower than the maximum sub-pixel value. The image data of the predetermined image may have one sub-pixel value different from other sub-pixel values.

The method of determining the linear function is not limited to the method explained above. For example, the linear function may be determined by deriving a straight line which has a minimum deviation from a plurality of measured values using the least-squared method.

In S502, two points (a first chromaticity point α and a second chromaticity point β) on the straight line indicated by the linear function determined in S501 are selected. The first chromaticity point α is a chromaticity point of the light emitted from a light emitting element group using a predetermined driving signal when the degree of temporal change is a first degree. The first chromaticity point β is a chromaticity point of the light emitted from a light emitting element group using the predetermined driving signal when the degree of temporal change is a second degree. For example, a chromaticity point where the driving time is 2000 hours is selected as the first chromaticity point α, and a chromaticity point where the driving time is 0 hour is selected as the second chromaticity point β.

Figure 3:
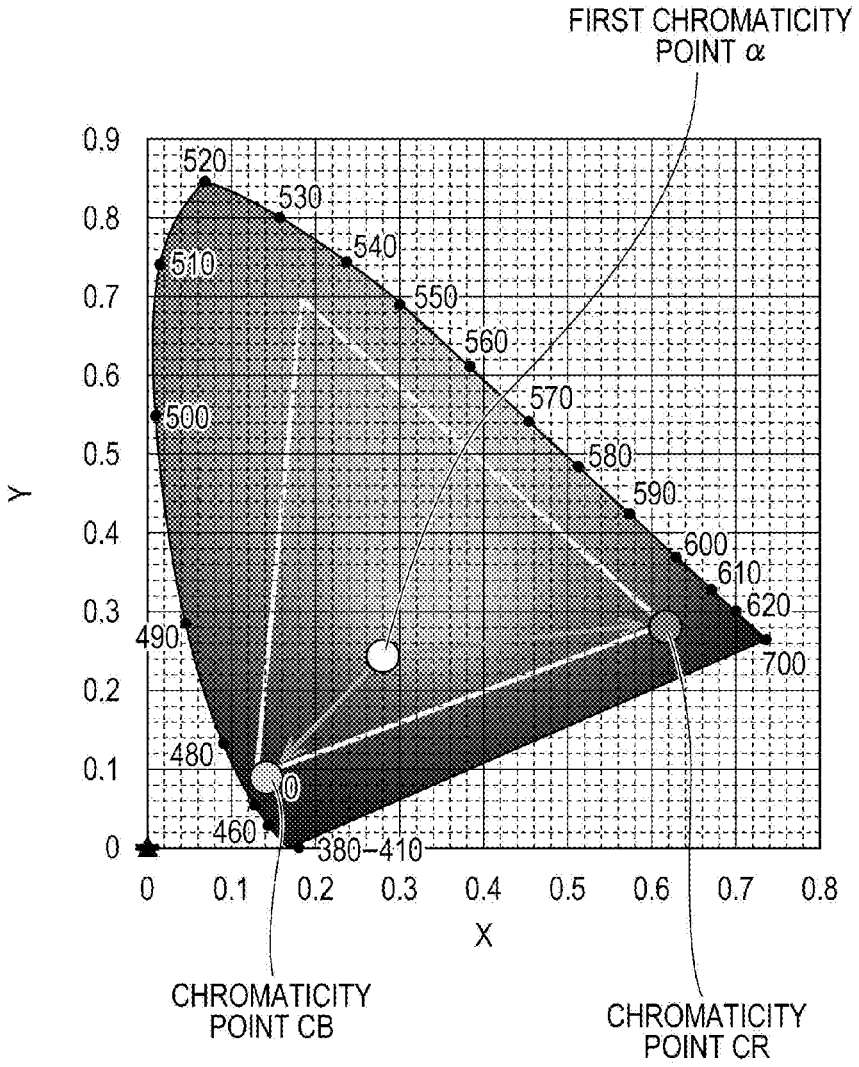
FIG. 3 is an example XY chromaticity diagram that depicts the position of the first chromaticity point α and the chromaticity points CB and CR.

In S503, a first slope Sa, corresponding to a slope of a straight line indicates a chromaticity change in a case where the emission brightness of the R element (first light emitting element) is adjusted, is obtained. Also in S503, a second slope Sb, corresponding to a slope of a straight line indicates a chromaticity change in a case where the emission brightness of the B element (second light emitting element) is adjusted, is obtained. FIG. 3 is an example XY chromaticity diagram that depicts position of the first chromaticity point α and the chromaticity point CB and CR. The first slope Sa of the straight line indicates the chromaticity change in the case where the emission brightness of the R element is adjusted to correspond to a slope of the straight line that passes the first chromaticity point α and the chromaticity point CR in FIG. 3. The second slope Sb of the straight line indicates the chromaticity change in the case where the emission brightness of the B element is adjusted to correspond to a slope of the straight line that passes the first chromaticity point α and the chromaticity point CB in FIG. 3.

In S504, chromaticity shift amount Rm and Bm for shifting the chromaticity from the chromaticity point α to the chromaticity point β are calculated. The chromaticity shift amount Rm corresponds to a chromaticity shift amount in a case where the emission brightness of the R element (first element) is adjusted. The chromaticity shift amount Bm corresponds to a chromaticity shift amount in a case where the emission brightness of the B element (second element) is adjusted.

The following formula (1) indicates a linear chromaticity shift in a case where the emission brightness of the R element (first element) is adjusted. The following formula (2) indicates a linear chromaticity shift in a case where the emission brightness of the B element (second element) is adjusted. The slope Sa in the formula (1) is the first slope which is obtained in S503. The slope Sb in the formula (2) is the second slope which is obtained in S503. The formula (1) and (2) are also completed between the chromaticity point α and β.

$$Y=Sa\times X \tag{1}$$

$$Y=Sb\times X \tag{2}$$

Figure 4:
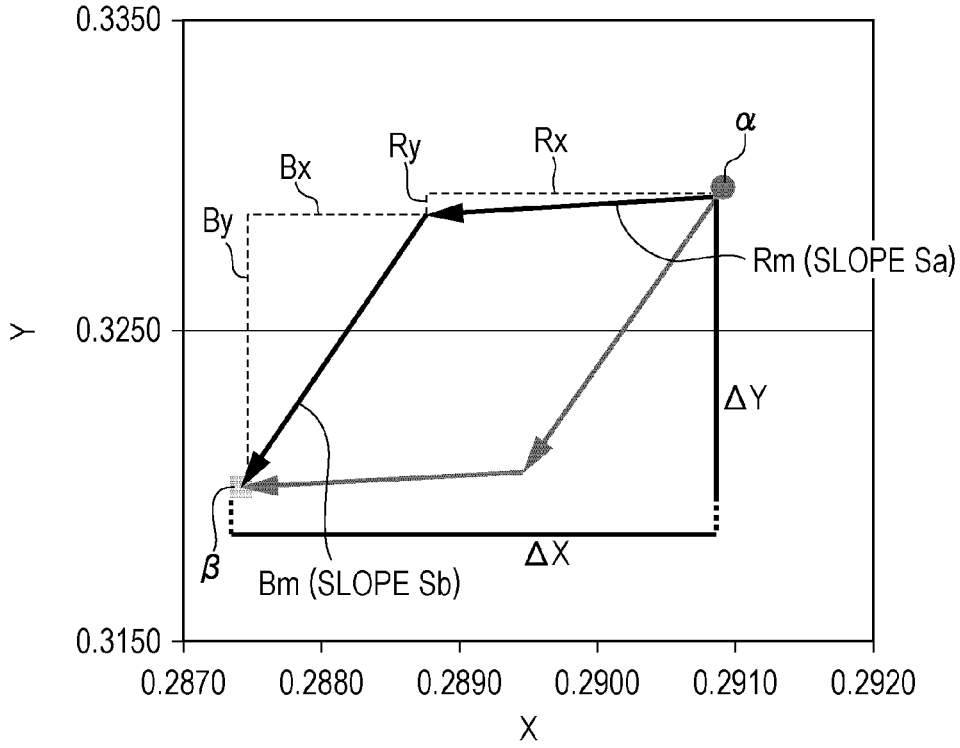
FIG. 4 is an example XY chromaticity diagram that depicts the chromaticity shift amount between the chromaticity points α and β.

The following formula (3) indicates a difference ΔX of X value between the chromaticity point α and β. The following formula (4) indicates a difference ΔY of Y value between the chromaticity point α and β. FIG. 4 is an example XY chromaticity diagram that depicts the chromaticity shift amount between the chromaticity point α and β. Referring to FIG. 4, the shift amount Rx in the formula (3) is the shift amount of X value derived by decomposing the chromaticity shift amount Rm into X value and Y value. The shift amount Ry in the formula (4) is the shift amount of y value derived by decomposing the chromaticity shift amount Rm into X value and Y value.

The shift amount Bx in the formula (3) is the shift amount of X value derived by decomposing the chromaticity shift amount Bm into X value and Y value. The shift amount By in the formula (4) is the shift amount of y value derived by decomposing the chromaticity shift amount Bm into X value and Y value.

$$\Delta X=Rx+Bx \tag{3}$$

$$\Delta Y=Ry+By \tag{4}$$

The following formula (5) and (6) are derived from the formula (1) and (2).

$$Ry=Sa\times Rx \tag{5}$$

$$By=Sb\times Bx \tag{6}$$

The following formula (7) to (10) are derived from the formula (3) to (6). In the formula (7) to (10), values of Sa, Sb, ΔX, and ΔY are known values. Thus, the shift amount Rx, Ry, Bx, and By are calculated using formula (7) to (10).

$$Rx=-(Sa\times\Delta X-\Delta Y)\div(Sa-Sb) \tag{7}$$

$$Ry=-Sa\times(Sb\times\Delta X-\Delta Y)\div(Sa-Sb) \tag{8}$$

$$Bx=(Sa\times\Delta X-\Delta Y)\div(Sa-Sb) \tag{9}$$

$$By=Sb\times(Sa\times\Delta X-\Delta Y)\div(Sa-Sb) \tag{10}$$

The following formula (11) is derived from the formula (7) and (8). The following formula (12) is derived from the formula (9) and (10).

In S504, the chromaticity shift amount Rm and Bm are calculated using the formula (11) and (12). The chromaticity shift amount Rm corresponds to a distance (first distance)

between the first chromaticity point α and an intersection point of a first straight line which passes the first chromaticity point α and has the first slope Sa and a second straight line which passes the second chromaticity point β and has the second slope Sb. The chromaticity shift amount Bm corresponds to a distance (second distance) between the second chromaticity point β and the intersection point.

$$Rm = (Rx^2 + Ry^2)^{1/2} = ((Sb \times \Delta X - \Delta Y) \div (Sa - Sb)) \times (1 + Sa^2)^{1/2} \quad (11)$$

$$Bm = (Bx^2 + By^2)^{1/2} = ((Sa \times \Delta X - \Delta Y) \div (Sa - Sb)) \times (1 + Sb^2)^{1/2} \quad (12)$$

In S505, first adjustment amount Rr of R value and second adjustment amount Br of B value for shifting the chromaticity from the chromaticity point α to the chromaticity point β are calculated. The first adjustment amount Rr is the adjustment amount of the emission brightness of the R element for shifting the chromaticity from the chromaticity point α to the chromaticity point β. The second adjustment amount Br is the adjustment amount of the emission brightness of the B element for shifting the chromaticity from the chromaticity point α to the chromaticity point β.

In this example of the display apparatus, the first adjustment amount Rr is calculated by dividing the chromaticity shift amount Rm derived in S504 by a first variable n1. And, the second adjustment amount Br is calculated by dividing the chromaticity shift amount Bm derived in S504 by a second variable n2. Specifically, the first adjustment amount Rr is calculated using following formula (13), and the second adjustment amount Br is calculated using following formula (14). The first variable n1 is the chromaticity shift amount of the light emitted from a light emitting element group in a case where a unit of R value is shifted. The second variable n2 is the chromaticity shift amount of the light emitted from a light emitting element group in a case where a unit of B value is shifted. In other words, the first variable n1 is the chromaticity shift amount of the light emitted from a light emitting element group in a case where a unit of the emission brightness of the R element is shifted. And, the second variable n2 is the chromaticity shift amount of the light emitted from a light emitting element group in a case where a unit of the emission brightness of the B element is shifted.

For example, the first variable n1 and the second variable n2 are calculated using measured values of the chromaticity of the light emitted from the light emitting group. Specifically, the first variable n1 is the difference between the measured value of the R value before shifting a unit of R value and the measured value of the R value after shifting a unit of R value. And, the second variable n2 is the difference between the measured value of the B value before shifting a unit of B value and the measured value of the B value after shifting a unit of B value. The chromaticity may be measured using a chromaticity sensor.

$$Rr = Rm \div n1 = ((Sb \times \Delta X - \Delta Y) \div (n1 \times (Sa - Sb))) \times (1 + Sa^2)^{1/2} \quad (13)$$

$$Br = Bm \div n2 = ((Sa \times \Delta X - \Delta Y) \div (n2 \times (Sa - Sb))) \times (1 + Sb^2)^{1/2} \quad (14)$$

In S506, an adjustment ratio which is the ratio of the first adjustment amount Rr to the second adjustment amount Br is determined using the following formula (15).

$$Rr : Br = ((Sb \times \Delta X - \Delta Y) \div (n1 \times (Sa - Sb))) \times (1 + Sa^2)^{1/2} : ((Sa \times \Delta X - \Delta Y) \div (n2 \times (Sa - Sb))) \times (1 + Sb^2)^{1/2} = ((Sb \times \Delta X - \Delta Y) \div n1) \times (1 + Sa^2)^{1/2} : ((Sa \times \Delta X - \Delta Y) \div n2) \times (1 + Sb^2)^{1/2} \quad (15)$$

In S507, the first adjustment information, which indicates correspondence between adjustment parameters to be designated by a user and adjustment amounts of R value and B value, is generated such that the adjustment ratio determined in S506 is maintained. Specifically, the bigger the adjustment parameter is, the bigger the adjustment amount of R value and the adjustment amount of B value are. In the first adjustment information, the ratio of the adjustment amount of R value to the adjustment amount of B value is maintained regardless of the adjustment parameters.

In S508, the first adjustment information generated in S507 is stored in the storage unit 107.

(Color Adjustment Process)

The color adjustment process of this example of the display apparatus is explained as follows.

Figure 6:
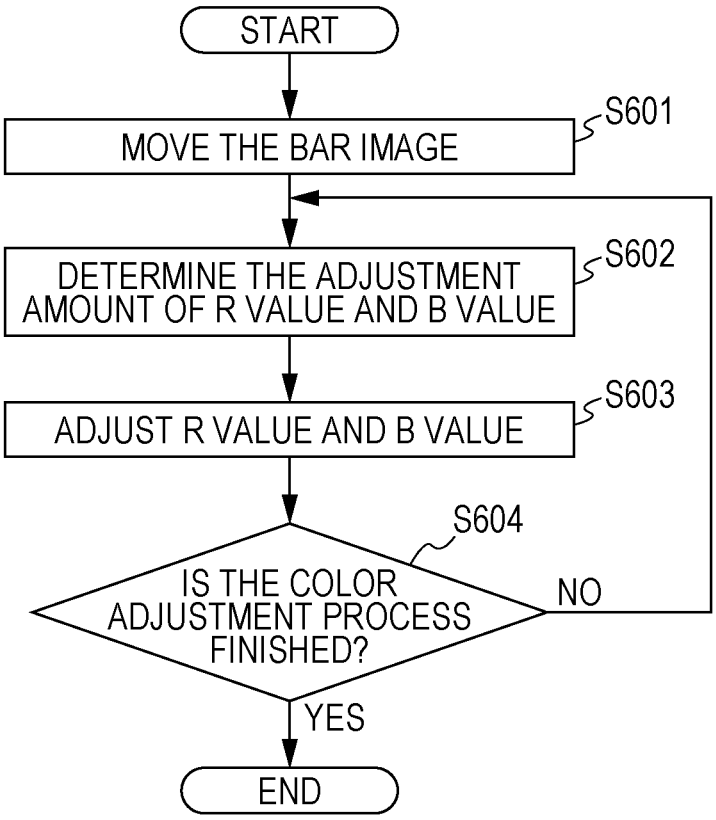
FIG. 6 is an example flow chart of the color adjustment process of this example of the display apparatus.

FIG. 6 is an example flow chart of the color adjustment process of this example of the display apparatus.

Figure 7:
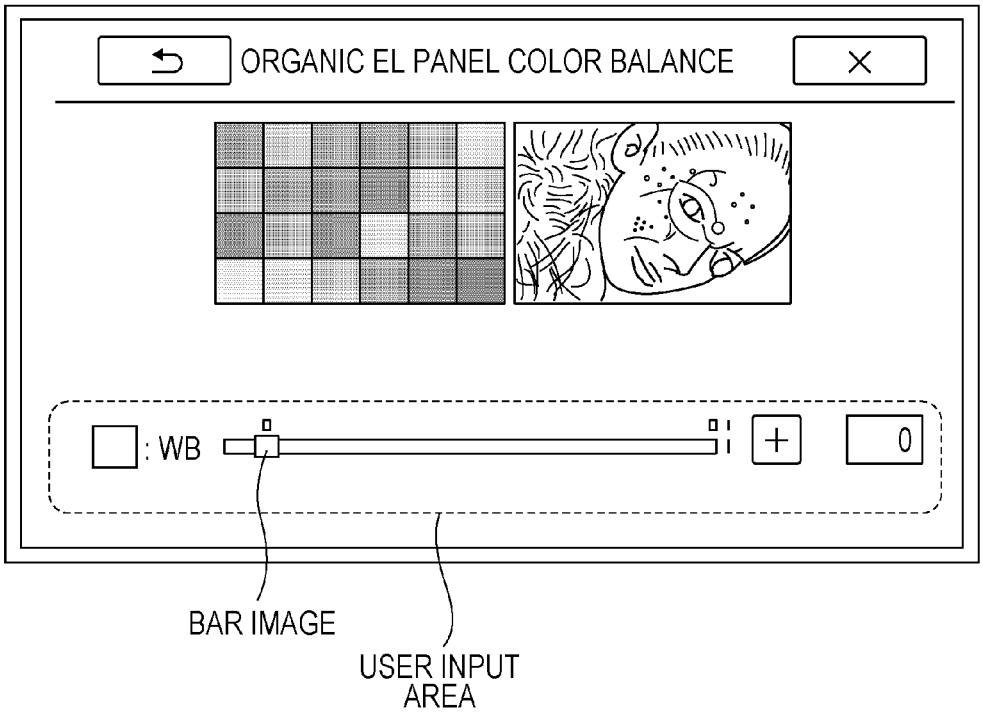
FIG. 7 depicts an example parameter adjustment image having a user input area operable by a user to designate an adjustment parameter.

In response to a user instruction via the user input unit 102, a parameter adjustment image is displayed on the screen. FIG. 7 depicts an example parameter adjustment image having a user input area operable by a user to designate an adjustment parameter.

In S601, the user moves a bar image in the user input area via the user input unit 102 to adjust white balance of the display unit 103.

In S602, the control unit 104 determines the adjustment amount of R value and the adjustment amount of B value in accordance with the user input. Specifically, the control unit 104 sets an adjustment parameter corresponding to the movement of the bar image in a case where the user moves the bar image. Then, the control unit 104 obtains the adjustment amount of R value and the adjustment amount of B value corresponding to the set adjustment parameter using the first adjustment information in the storage unit 107. And, the control unit 104 outputs the obtained adjustment amount of R value and the obtained adjustment amount of B value to the WB adjustment unit 106.

In S603, the WB adjustment unit 106 performs the color adjustment process to the image data outputted from the digital signal processor 105. In the color adjustment process, R value and B value of the image data are adjusted. The WB adjustment unit 106 outputs the image data of which the color adjustment process was performed to the display unit 103. Thus, the emission color of the light emitting groups is adjusted to compensate (decrease) the color shift due to the temporal changes of the emission color of the light emitting groups.

In S604, the control unit 104 determines whether an user instruction to finish the color adjustment process is inputted or not. For example, after the user verified the image of which the color adjustment process was performed, the user designates to finish the color adjustment process. If the control unit 104 determines the user instruction to finish the color adjustment process is inputted, the flow in FIG. 6 finishes. If the user moves the bar image, the operation proceeds from S604 to S602.

According to this example of the display apparatus, sub-pixel values of the two adjustment elements are adjusted in conjunction such that the predetermined adjustment ratio is maintained. In other words, the emission brightness of the two adjustment elements is adjusted in conjunction such that the predetermined adjustment ratio is maintained. Thus, the emission color of the light emitting groups is adjusted to a desired color easily. Specifically, the number of adjustment parameter type to be adjusted is decreased, and the user can adjust the emission color of the light emitting element groups to the desired color with short time and low process load. In other words, the user can easily adjust the emission color of the light emitting element groups to the desired color by designating only one kind of adjustment parameter.

It is not limited to the example that the setting of the adjustment parameter and the color adjustment process is performed in response to the user's instruction. For example, the color adjustment process may be automatically performed periodically. The emission color of the light emitting element groups may be automatically detected by color sensor periodically. The emission brightness of the first light emitting element and the second light emitting element may be automatically adjusted in conjunction such that the detected value of the emission color matches with a target value. The target value may be a fixed value predetermined by a product company or a value changeable in accordance with user's instruction.

It is not limited to the example that the display apparatus has the image pickup unit, and the image data is generated in the display apparatus. For example, the image data may input from external apparatus.

The second example of the display apparatus is explained as follows.

(Structure)

Figure 8:
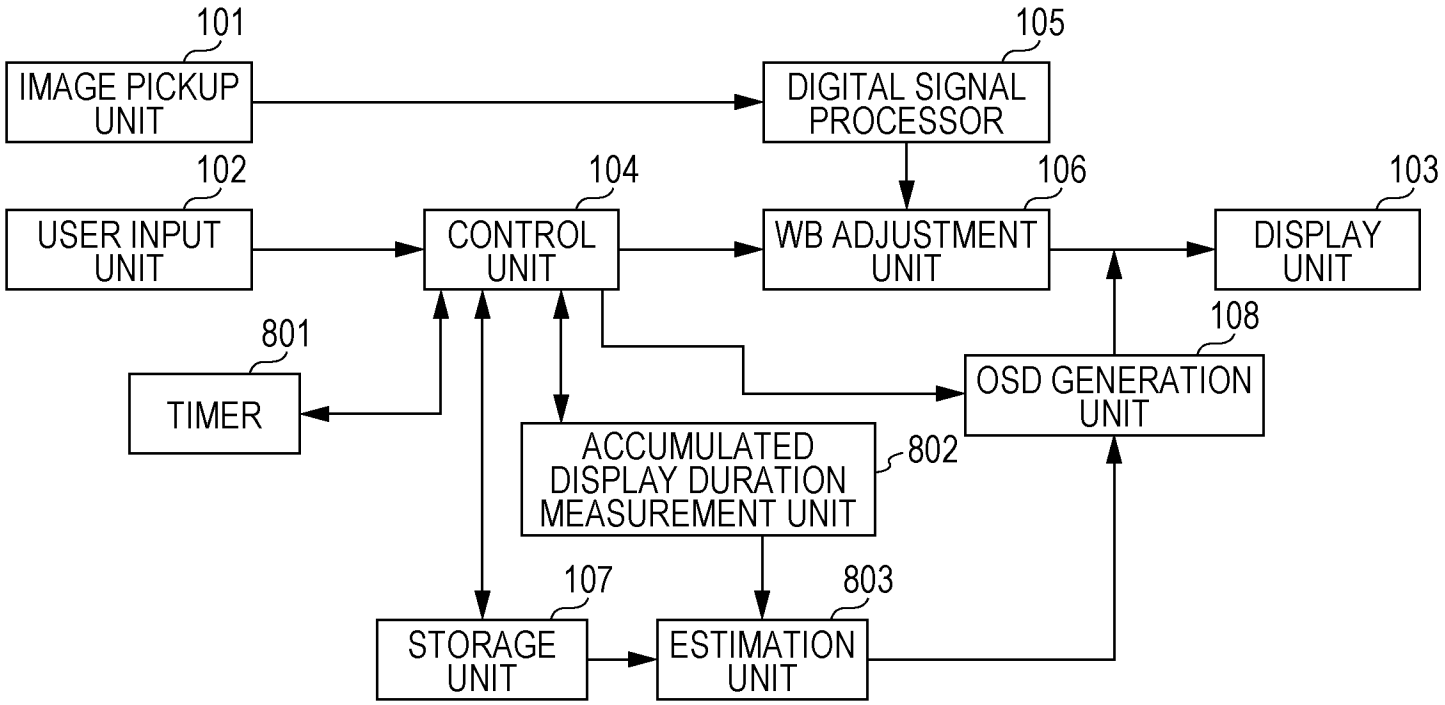
FIG. 8 is an example block diagram that depicts a display apparatus according to the second example of the display apparatus.

FIG. 8 is an example block diagram that depicts a display apparatus according to the second example of the display apparatus. Comparing the display apparatus in FIG. 8 with the display apparatus 100 in FIG. 1, a timer 801, an accumulated display duration measurement unit 802, and an estimation unit 803 are added.

In FIG. 8, the same reference signs are used for components similar to those of FIG. 1, and the details of similar components will not be repeated.

The timer 801 counts the display duration from the start of displaying to the present every time a display process is performed in the display apparatus (display unit 103). The timer 801 outputs the counted display duration as a first display duration to the control unit 104.

The accumulated display duration measurement unit 802 measures the present accumulated display duration of the display apparatus, and stores the accumulated display duration in the storage unit 107. Specifically, the accumulated display duration measurement unit 802 reads out the previous accumulated display duration from the storage unit 107, and obtains the first display duration from the control unit 104. Then, the accumulated display duration measurement unit 802 accumulates a light amount emitted from the light emitting element groups by a driving signal in the first display duration, and calculates a second display duration that is required to emit the same light amount from the light emitting element groups by a reference driving signal. The accumulated display duration measurement unit 802 obtains new accumulated display duration by adding the second display duration to the previous accumulated display duration.

For example, the reference driving signal is the same driving signal used when the chromaticity points depicted in FIG. 2 were measured. The driving signal of the light emitting element groups can be changed by changing a gamma setting value of the display unit 103. A user may change the gamma setting value of the display unit 103 via the user input unit 102.

The driving signal of the light emitting element groups may depend on not only the gamma setting value of the display unit 103 but also on the image data to be displayed. In this second example of the display apparatus, in order to simplify the explanation, the accumulated display duration measurement unit 802 calculates the accumulated display duration based on the change of the driving signal corresponding to the change of the gamma setting value of the display unit 103. Alternatively, the accumulated display duration measurement unit 802 may calculate the accumulated display duration depend on not only the change of the gamma setting value of the display unit 103 but also the change of the image data to be displayed. Then, the accumulated display duration may be calculated with higher accuracy.

In the second example of the display apparatus, the same predetermined image displayed when the first adjustment information was determined may be displayed in the color adjustment process. Then the accumulated display duration can be calculated with higher accuracy even if the accumulated display duration measurement unit 802 calculates the accumulated display duration based on the change of the driving signal corresponding to the change of the gamma setting value of the display unit 103 (not based on the change of the image data to be displayed).

Figure 9:
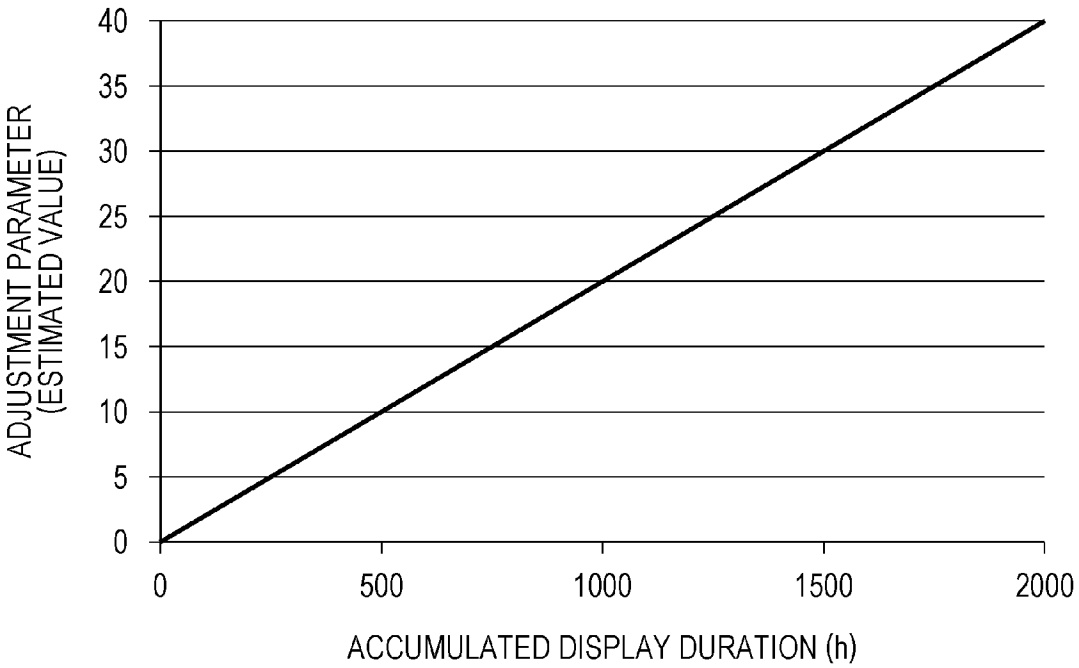
FIG. 9 depicts an example of the second adjustment information (function).

In the storage unit 107, the first adjustment information explained in the first example of the display apparatus and second adjustment information are stored in advance in the second example of the display apparatus. The second adjustment information (function or data table) indicates correspondence between estimated adjustment parameters and accumulated display durations of the display apparatus. FIG. 9 depicts an example of the second adjustment information (function). In FIG. 9, the horizontal axis corresponds to the accumulated display duration (hours) and the vertical axis corresponds to the estimated adjustment parameters. The function depicted in FIG. 9 is obtained by the operation from S501 to S505 in FIG. 5.

Specifically, in S502 of FIG. 5, a chromaticity point where the driving time is 2000 hours is selected as the first chromaticity point $\alpha$, and a chromaticity point where the driving time is zero hour is selected as the second chromaticity point $\beta$. Then, in S505 of FIG. 5, first adjustment amount Rr of R value and second adjustment amount Br of B value for shifting the chromaticity from the chromaticity point $\alpha$ to the chromaticity point $\beta$ are calculated. The adjustment parameter corresponding to the calculated first adjustment amount Rr of R value and the calculated second adjustment amount Br of B value is set as the estimated adjustment parameter (40) corresponding to the accumulated display duration "2000 hours". And, "zero" is set as the estimated adjustment parameter corresponding to the accumulated display duration "zero hour". Then, the linear function, having accumulated display durations and estimated adjustment parameters as variables pass the point corresponding to the estimated adjustment parameter "40" and the accumulated display duration "2000 hours" and the point corresponding to the estimated adjustment parameter "zero" and the accumulated display duration "zero hour", is obtained.

The first adjustment amount Rr and the second adjustment amount Br for shifting the chromaticity to the chromaticity point β when the driving time is zero may be calculated in every driving time unit. And, estimated adjustment parameter corresponding to the calculated first adjustment amount Rr and the calculated second adjustment amount Br may be set in every driving time unit (and every accumulated display duration unit). A linear function may be determined by deriving a straight line which has a minimum deviation from a plurality of adjustment parameters estimated in every driving time unit (and every accumulated display duration unit), by using the least-squared method.

The estimation unit 803 determines an estimated adjustment parameter corresponding to an accumulated display duration measured by the accumulated display duration measurement unit 802 based on the second adjustment information in the storage unit 107. Then, the estimation unit 803 outputs the estimated adjustment parameter to the OSD generation unit 108.

The OSD generation unit 108 has similar function explained in the first example of the display apparatus. The OSD generation unit 108 has the additional function to notify the estimated adjustment parameter outputted from the estimation unit 803. Specifically, an estimated adjustment guide display area that indicates an estimated adjustment range including the estimated adjustment parameter is combined with the parameter adjustment image and displayed on the screen. For example, the estimated adjustment range is a range having a predetermined width, and the estimated adjustment parameter outputted from the estimation unit 803 is located in the center of the estimated adjustment range. The estimated adjustment guide display area includes a rectangular image indicating the estimated adjustment range and texts such as "estimated adjustment range".

Alternatively, the process for notifying the estimated adjustment parameter may be performed by a function unit other than the OSD generation unit 108. For example, the display apparatus may have a notification unit for notifying the estimated adjustment parameter.

The estimated adjustment parameter itself may be notified instead of the estimated adjustment range.

Figure 11:
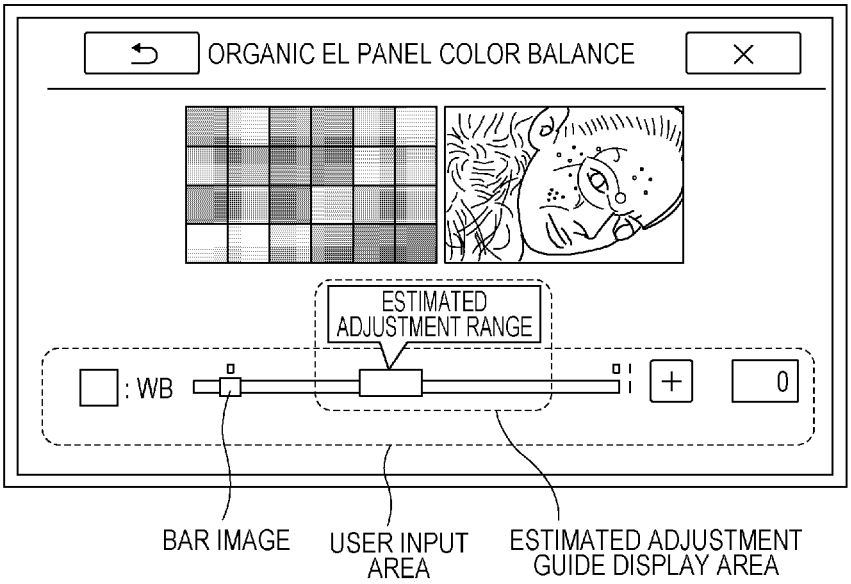
FIG. 11 depicts an example parameter adjustment image having an estimated adjustment guide display area.

FIG. 11 depicts an example parameter adjustment image having the estimated adjustment guide display area. The screen for displaying the estimated adjustment parameter is not limited to the screen depicted in FIG. 11. For example, the estimated adjustment guide display area may not include text such as "estimated adjustment range", or may not include the rectangular image indicating the estimated adjustment range. The estimated adjustment parameter may be notified by audio.

(Color Adjustment Process)

The color adjustment process of this second example of the display apparatus is explained as follows.

Figure 10:
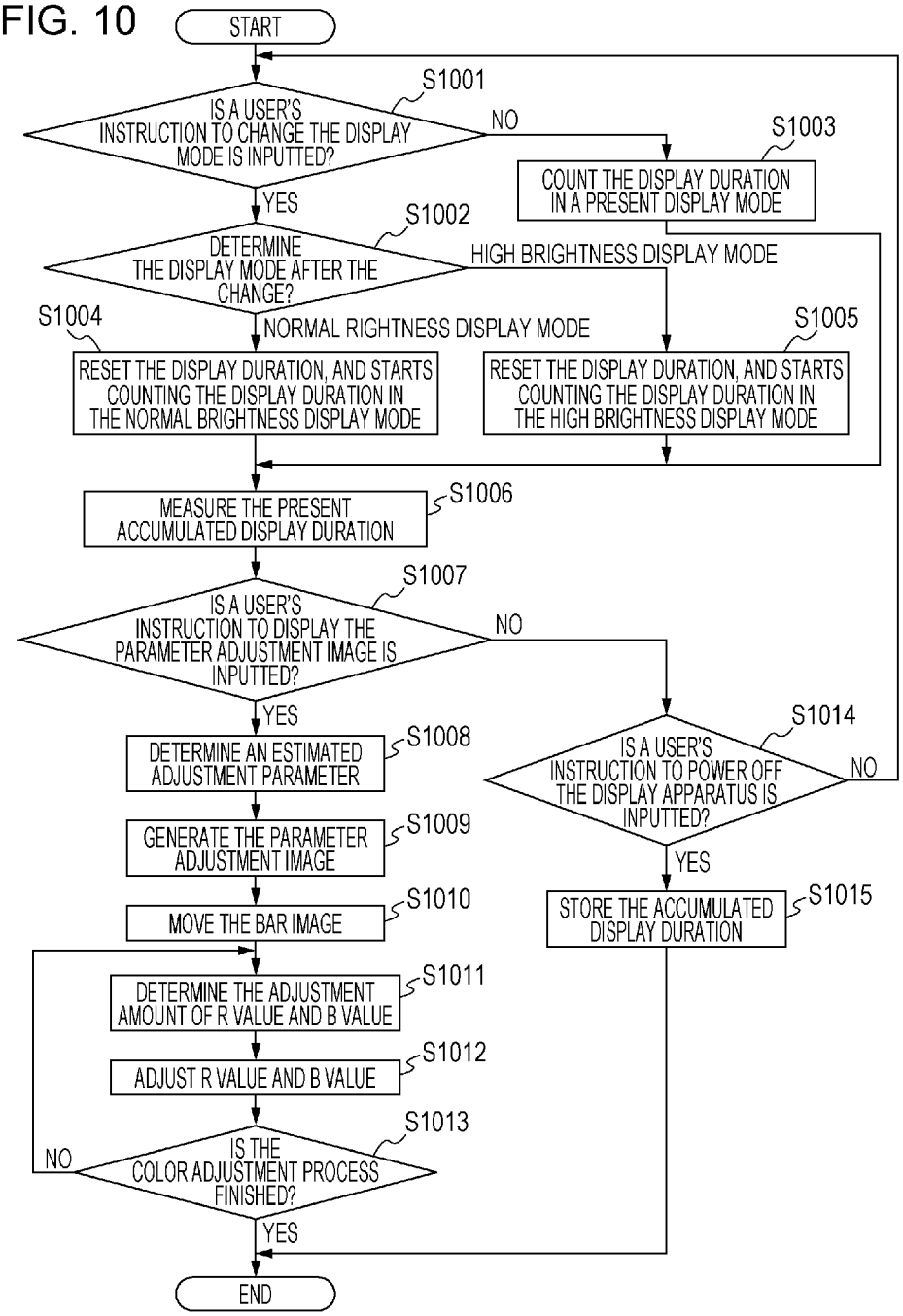
FIG. 10 is an example flow chart of the color adjustment process of this second example of the display apparatus.

FIG. 10 is an example flow chart of the color adjustment process of this second example of the display apparatus. The display apparatus of this second example has two display modes including a normal brightness display mode for displaying images with normal brightness using a first gamma setting value and a high brightness display mode for displaying images with high brightness using a second gamma setting value.

In S1001, the control unit 104 determines whether a user's instruction to change the display mode is inputted or not. If the user's instruction to change the display mode is inputted, the operation proceeds to S1002. If the user's instruction to change the display mode is not inputted, the operation proceeds to S1003.

In S1002, the control unit 104 determines the display mode instructed by the user. If the display mode is changed from the high brightness display mode to the normal brightness display mode, the operation proceeds to S1004. If the display mode is changed from the normal brightness display mode to the high brightness display mode, the operation proceeds to S1005.

In S1003, the timer 801 counts the display duration in a present display mode, and outputs the counted display duration to the accumulated display duration measurement unit 802 via the control unit 104. Then the operation proceeds to S1006.

In S1004, the control unit 104 resets the display duration in the high brightness display mode counted by the timer 801. Then, the timer 801 starts counting the display duration in the normal brightness display mode, and outputs the counted display duration in the normal brightness display mode to the accumulated display duration measurement unit 802 via the control unit 104. Then the operation proceeds to S1006.

In S1005, the control unit 104 resets the display duration in the normal brightness display mode counted by the timer 801. Then, the timer 801 starts counting the display duration in the high brightness display mode, and outputs the counted display duration in the high brightness display mode to the accumulated display duration measurement unit 802 via the control unit 104. Then the operation proceeds to S1006.

In S1006, the accumulated display duration measurement unit 802 measures the present accumulated display duration of the display apparatus. Specifically, the accumulated display duration measurement unit 802 obtains, from the control unit 104, the first display duration counted by timer 801 and display mode information indicating the display mode set when the timer 801 counted the first display duration. The accumulated display duration measurement unit 802 also reads out the previous accumulated display duration from the storage unit 107. Then, the accumulated display duration measurement unit 802 calculates the second display duration corresponding to the reference driving signal based on the display mode information. The accumulated display duration measurement unit 802 obtains new accumulated display duration by adding the second display duration to the previous accumulated display duration.

In this second example of the display apparatus, the ratio of "the emission brightness (display brightness) in the normal brightness display mode" to "the emission brightness (display brightness) in the high brightness display mode" is 1:2. And, the degradation speed of the light emitting element groups, which corresponds to the temporal change speed of the emission brightness, is proportional to the square of the emission brightness of the light emitting element groups. Thus, the ratio of "the degradation speed of the light emitting element groups in the normal brightness display mode" to "the degradation speed of the light emitting element groups in the high brightness display mode" is 1:4.

In a case where the driving signal in the normal brightness display mode is the reference driving signal, the following formula (formula 16) is established. In S1006, the accumulated display duration measurement unit 802 measures the present accumulated display duration of the display apparatus using the formula (16). In formula (16), Ts indicates the second display duration, Tm indicates the first display duration in the normal brightness display mode, Th indicates the first display duration in the high brightness display mode.

$$Ts=Tm+4\times Th \quad (16)$$

In S1007, the control unit 104 determines whether an user's instruction to display the parameter adjustment image is inputted or not. If the user's instruction to display the parameter adjustment image is inputted, the operation proceeds to S1008. If the user's instruction to display the parameter adjustment image is not inputted, the operation proceeds to S1014.

In S1008, the estimation unit 803 determines an estimated adjustment parameter. Specifically, the estimation unit 803 obtains the accumulated display duration from the accumulated display duration measurement unit 802, and obtains the second adjustment information from the storage unit 107. Then, the estimation unit 803 determines an estimated adjustment parameter corresponding to the accumulated display duration measured by the accumulated display duration measurement unit 802 based on the second adjustment information in the storage unit 107. Then, the estimation unit 803 outputs the estimated adjustment parameter to the OSD generation unit 108.

In S1009, the OSD generation unit 108 generates the parameter adjustment image including the estimated adjustment parameter outputted from the estimation unit 803. Specifically, the parameter adjustment image depicted in FIG. 11 is displayed on the screen.

Then, in S1010, the user moves a bar image in the user input area via the user input unit 102 to adjust white balance of the display unit 103. Comparing the parameter adjustment image in FIG. 11 with the parameter adjustment image in FIG. 7, the estimated adjustment range is additionally displayed in the parameter adjustment image. Thus, the user can determine the adjustment parameter easily. Specifically, the user can easily adjust the emission color of the light emitting element groups to the desired color by designating the adjustment parameter in the parameter adjustment image.

S1011-S1013 in FIG. 10 are similar to S602-S604 in FIG. 6. Therefore, detailed descriptions of S1011-S1013 in FIG. 10 will not be repeated.

In S1014, the control unit 104 determines whether a user's instruction to power off the display apparatus is inputted or not. If the user's instruction to power off the display apparatus is not inputted, the operation turns back to S1001. If the user's instruction to power off the display apparatus is inputted, the operation proceeds to S1015.

In S1015, the accumulated display duration measurement unit 802 stores, in the storing unit 107, the accumulated display duration measured in S1006.

According to this second example of the display apparatus, an appropriate adjustment parameter is estimated based on the accumulated display duration, and the estimated adjustment parameter is notified to the user. Thus, the emission color of the light emitting groups is adjusted to a desired color easily.

The number of display modes (gamma setting values) to be set is not limited to two. The number of display modes (gamma setting values) to be set may be more than two.

If the degradation speed of the light emitting element groups does not depend on the driving signal of the light emitting element groups, the accumulated display duration measurement unit 802 may not perform the calculation using the formula 16.

An appropriate adjustment parameter may be set automatically. For example, third adjustment information may be stored in the storage unit 107. The third adjustment information (function or data table) indicates correspondence between accumulated display durations of the display apparatus and adjustment amounts of the emission brightness of the two adjustment elements. The WB adjustment unit 106 may automatically adjust the emission brightness of the two adjustment elements by the adjustment amount corresponding to the accumulated display duration measured by the accumulated display duration measurement unit 802 based on the third adjustment information. In that case, a user's instruction to adjust the adjustment parameter is not necessary.

Figure 12:
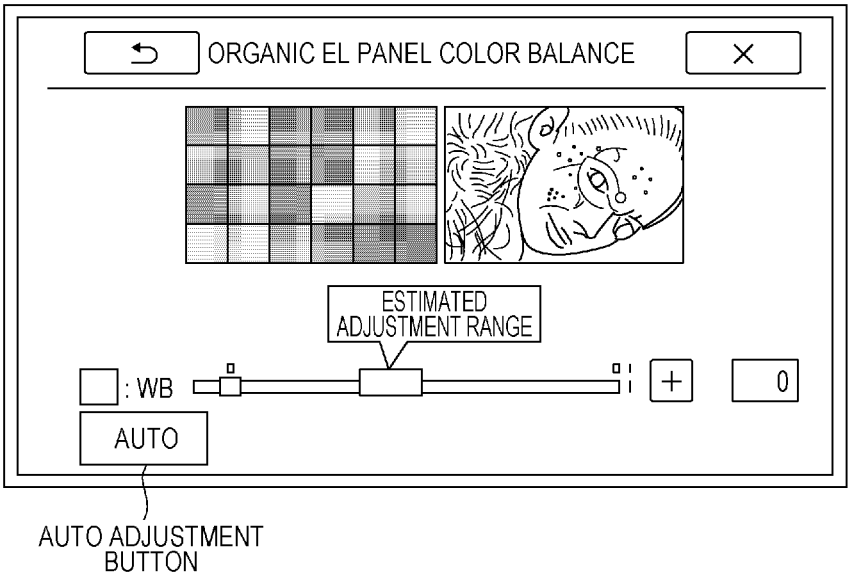
FIG. 12 depicts an example parameter adjustment image having an auto adjustment button.

Alternatively, a parameter adjustment image may include an auto adjustment button depicted in FIG. 12. FIG. 12 depicts an example parameter adjustment image having an auto adjustment button. In that case, an adjustment parameter estimated by the estimation unit 803 is set to adjust the emission color of the light emitting element groups in response to the user operation of pressing the auto adjustment button. Specifically, the estimation unit 803 outputs an estimated adjustment parameter to the control unit 104. Then, the control unit 104 determines an adjustment amount corresponding to the estimated adjustment parameter based on the first adjustment information, and outputs the determined adjustment amount to the WB adjustment unit 106. The WB adjustment unit 106 performs the color adjustment process on the image data with the adjustment amount being outputted from the control unit 104.

The user may be able to amend the adjustment parameter after the estimated adjustment parameter is set. The third example of the display apparatus is explained as follows.

Figure 13:
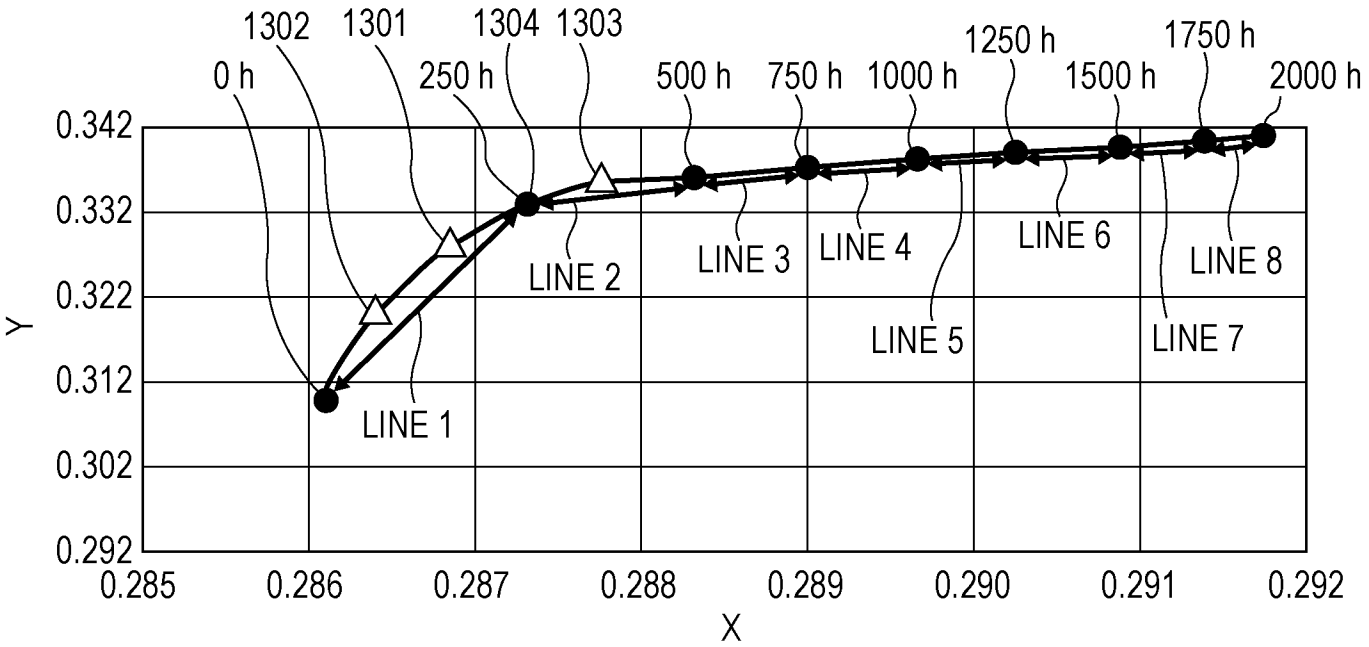
FIG. 13 is an example XY chromaticity diagram that depicts the temporal changes of the emission color of the light emitting groups.

In the first and the second example of the display apparatus, the emission color of the light emitting element groups changed lineally based on elapsed time as depicted in FIG. 2. In this third example of the display apparatus, the emission color of the light emitting element groups changes non-lineally based on elapsed time as depicted in FIG. 13. Even in that case, the emission color of the light emitting element groups can be adjusted by the user to the intended color easily and with high accuracy.

(Structure)

The structure of the display apparatus in this third example is similar to the structure of the display apparatus in the second example.

However, in the second example of the display apparatus, plural adjustment ratios corresponding to plural ranges of accumulated display durations of the display apparatus are stored in the storage unit 107 in advance. Specifically, the first adjustment information and the second adjustment information corresponding to every 250 hours ranges are generated and stored in the storage unit 107 in advance. FIG. 13 is an example XY chromaticity diagram that depicts the temporal changes of the emission color of the light emitting groups. The first adjustment information corresponding to each of the eight lines 1-8 depicted in FIG. 13 are stored in the storage unit 107 in advance. The second adjustment information corresponding to each of the eight lines 1-8 depicted in FIG. 13 are also stored in the storage unit 107 in advance.

Each of the lines 1-8 indicates a linear function corresponding to temporal changes of the emission color of the light emitted from a light emitting element groups. The first adjustment information and the second adjustment information are generated in the same way explained in the first and the second example of the display apparatus. The first adjustment information corresponding to the line whose accumulated display duration is T1 to T2 is used to compensate (decrease) the color shift due to the temporal changes of the emission color of the light emitting groups corresponding to the accumulated display duration T1 to T2. The estimated adjustment parameter includes the second adjustment information, which is the parameter used to adjust the emission color of the light emitting element groups (from the emission color corresponding to the upper limit of the accumulated display duration of each line to the emission color corresponding to the lower limit of the accumulated display duration of each line). For example, the estimated adjustment parameter includes the second adjustment information corresponding to line 3 and is the parameter to adjust the emission color of the light emitting element groups from the emission color corresponding to 750 hours of the accumulated display duration to the emission color corresponding to 500 hours of the accumulated display duration.

(Color Adjustment Process)

The color adjustment process of this third example of the display apparatus is explained as follows.

Figure 14A:
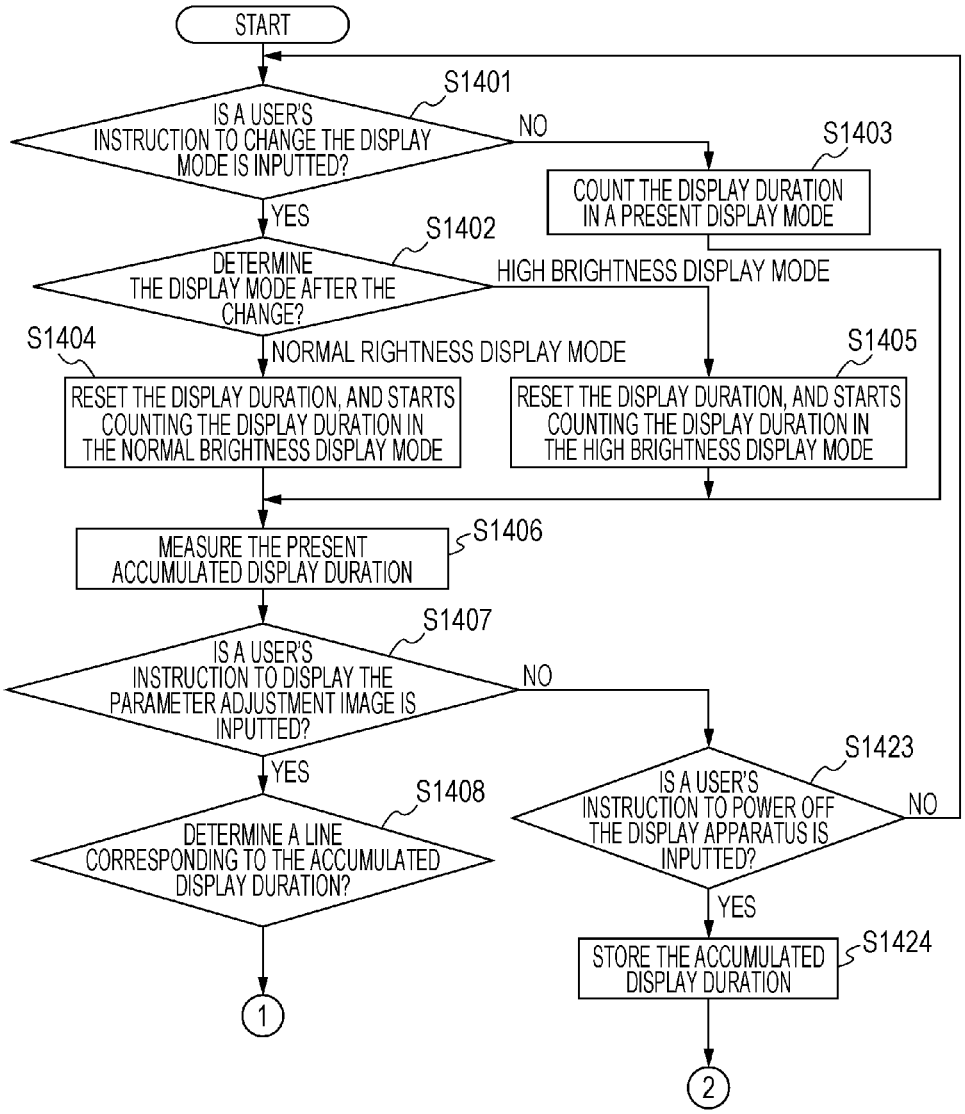
FIG. 14A is an example flow chart of a part of the color adjustment process of this third example of the display apparatus.
Figure 14B:
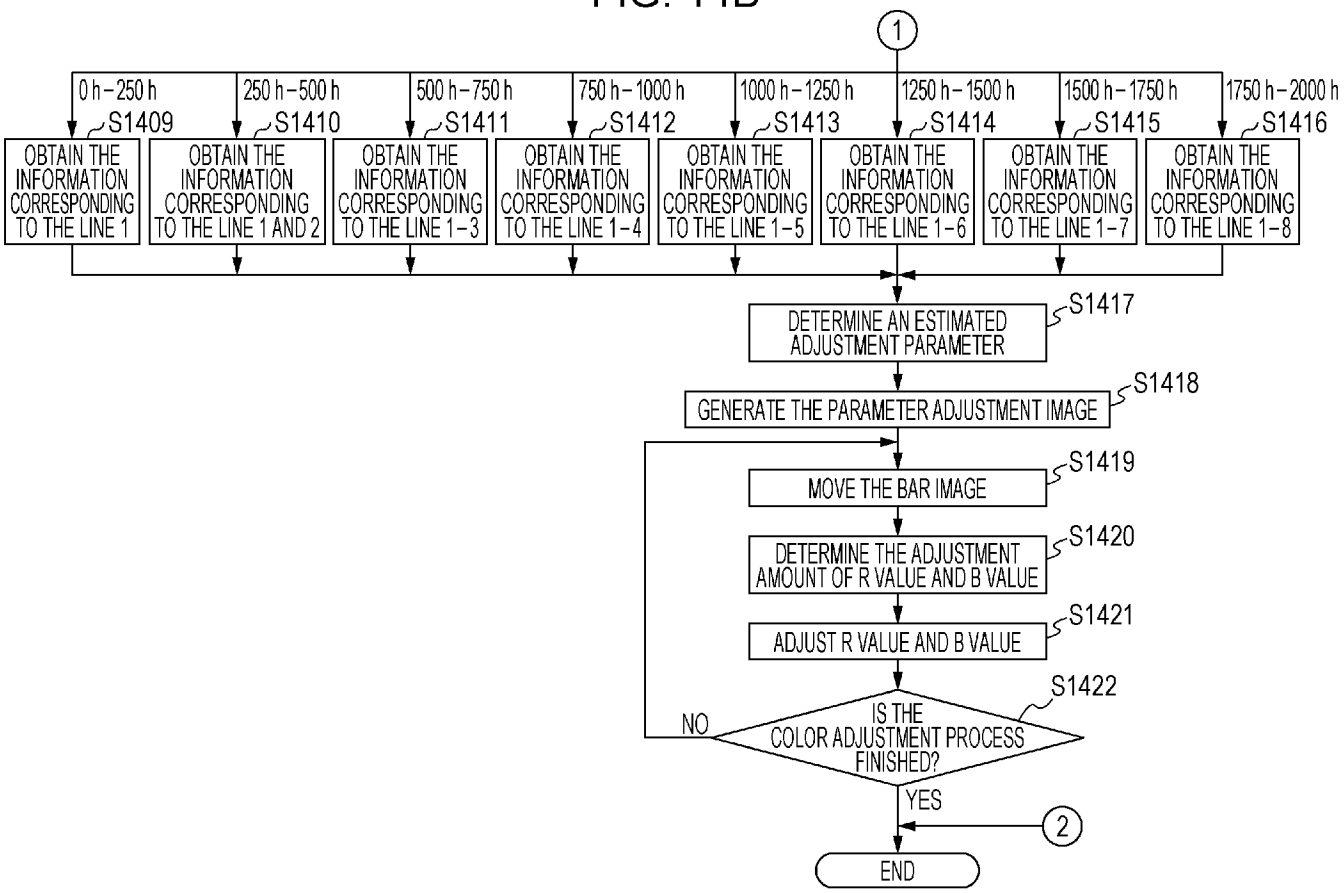
FIG. 14B is an example flow chart of another part of the color adjustment process of this third example of the display apparatus.

FIG. 14A is an example flow chart of a part of the color adjustment process of this third example of the display apparatus. FIG. 14B is an example flow chart of another part of the color adjustment process of this third example of the display apparatus.

S1401-S1407 in FIG. 14A are similar to S1001-S1007 in FIG. 10. Therefore, detailed descriptions of S1401-S1407 in FIG. 14A will not be repeated. If the user's instruction to display the parameter adjustment image is input, the operation proceeds from S1407 to S1408. If the user's instruction to display the parameter adjustment image is not input, the operation proceeds from S1407 to S1423.

S1423 and 1424 in FIG. 14A are similar to S1014 and 1015 in FIG. 10. Therefore, detailed descriptions of S1423 and S1424 in FIG. 14A will not be repeated.

In S1408, the control unit 104 determines a line corresponding to the accumulated display duration calculated in S1406.

Referring to FIG. 13, line 1 corresponds to the accumulated display duration zero hour to 250 hours. Line 2 corresponds to the accumulated display duration 250 hours to 500 hours. Line 3 corresponds to the accumulated display duration 500 hours to 750 hours. Line 4 corresponds to the accumulated display duration 750 hours to 1000 hours. Line 5 corresponds to the accumulated display duration 1000 hours to 1250 hours. Line 6 corresponds to the accumulated display duration 1250 hours to 1500 hours. Line 7 corresponds to the accumulated display duration 1500 hours to 1750 hours. Line 8 corresponds to the accumulated display duration 1750 hours to 2000 hours.

If the accumulated display duration calculated in S1406 is equal to or more than zero hour and less than 250 hours, the operation proceeds from S1408 to S1409.

If the accumulated display duration calculated in S1406 is equal to or more than 250 hours and less than 500 hours, the operation proceeds from S1408 to S1410.

If the accumulated display duration calculated in S1406 is equal to or more than 500 hours and less than 750 hours, the operation proceeds from S1408 to S1411.

If the accumulated display duration calculated in S1406 is equal to or more than 750 hours and less than 1000 hours, the operation proceeds from S1408 to S1412.

If the accumulated display duration calculated in S1406 is equal to or more than 1000 hours and less than 1250 hours, the operation proceeds from S1408 to S1413.

If the accumulated display duration calculated in S1406 is equal to or more than 1250 hours and less than 1500 hours, the operation proceeds from S1408 to S1414.

If the accumulated display duration calculated in S1406 is equal to or more than 1500 hours and less than 1750 hours, the operation proceeds from S1408 to S1415.

If the accumulated display duration calculated in S1406 is equal to or more than 1750 hours and less than 2000 hours, the operation proceeds from S1408 to S1416.

Alternatively, the line 8 may corresponds to the accumulated display duration 1750 hours to infinity (no upper limit). In that case, If the accumulated display duration calculated in S1406 is equal to or more than 1750, the operation proceeds from S1408 to S1416.

In S1409, the estimation unit 803 obtains (reads out), from the storage unit 107, the first adjustment information and the second adjustment information each corresponding to the line 1.

In S1410, the estimation unit 803 obtains (readouts), from the storage unit 107, the first adjustment information and the second adjustment information each corresponding to the line 1-2.

In S1411, the estimation unit 803 obtains (reads out), from the storage unit 107, the first adjustment information and the second adjustment information each corresponding to the line 1-3.

In S1412, the estimation unit 803 obtains (reads out), from the storage unit 107, the first adjustment information and the second adjustment information each corresponding to the line 1-4.

In S1413, the estimation unit 803 obtains (reads out), from the storage unit 107, the first adjustment information and the second adjustment information each corresponding to the line 1-5.

In S1414, the estimation unit 803 obtains (reads out), from the storage unit 107, the first adjustment information and the second adjustment information each corresponding to the line 1-6.

In S1415, the estimation unit 803 obtains (reads out), from the storage unit 107, the first adjustment information and the second adjustment information each corresponding to the line 1-7.

In S1416, the estimation unit 803 obtains (reads out), from the storage unit 107, the first adjustment information and the second adjustment information each corresponding to the line 1-8.

S1417-S1422 in FIG. 14B are similar to S1008-S1013 in FIG. 10. Therefore, detailed descriptions of S1417-S1422 in FIG. 14B will not be repeated.

In S1407, the second adjustment information obtained in one of S1409-S1416 is used. In S1420, the first adjustment information obtained in one of S1409-S1416 is used.

For example, in the color adjustment process for shifting for the chromaticity from the chromaticity point 1301 where the driving time is less than 250 hours to the chromaticity point 1302 where the driving time is less than 250 hours, the emission brightness of adjustment elements is adjusted using an adjustment amount based on the first adjustment information corresponding to the line 1 in FIG. 13.

In the color adjustment process for shifting the chromaticity from the chromaticity point 1303 where the driving time is more than 250 hours to the chromaticity point 1302 where the driving time is less than 250 hours, an adjustment amount A1 for shifting the chromaticity from the chromaticity point 1303 to the chromaticity point 1304 is determined using the first adjustment information corresponding to the line 2, and an adjustment amount A2 for shifting the chromaticity from the chromaticity point 1304 to the chromaticity point 1302 is determined using the first adjustment information corresponding to the line 1. Then, the emission brightness of adjustment elements is adjusted using an adjustment amount A3 which is obtained by adding the adjustment amount A2 to adjustment amount A1.

Thus, in the color adjustment process for shifting the chromaticity, at least one of the plurality of the first adjustment information corresponding to the plurality of lines 1-8 are used depending on the chromaticity point to be shifted. Therefore, the emission color of the light emitting groups is adjusted to compensate (decrease) the color shift due to the temporal changes of the emission color of the light emitting groups.

Furthermore, when the accumulated display duration is less than 250 hours, an estimated adjustment parameter based on the second adjustment information corresponding to line 1 is notified to the user.

When the accumulated display duration is equal to or more than 250 hours and less than 500 hours, an estimated adjustment parameter B1 for adjusting the emission color of the light emitting element groups from the present emission color to the emission color corresponding to 250 hours of the accumulated display duration is determined based on the second adjustment information corresponding to line 2. And, an estimated adjustment parameter B2 for adjusting the emission color of the light emitting element groups from the emission color corresponding to 250 hours of the accumulated display duration to the emission color corresponding to zero hour of the accumulated display duration is determined based on the second adjustment information corresponding to line 1. And, an estimated adjustment parameter B3 for adjusting the emission color of the light emitting element groups from the present emission color to the emission color corresponding to zero hour of the accumulated display duration is determined by adding the estimated adjustment parameter B2 to the estimated adjustment parameter B1. Then, the estimated adjustment parameter B3 is notified to the user.

Thus, the estimated adjustment parameter is determined using at least one of the plurality of the second adjustment information corresponding to the plurality of lines 1-8 depending on the present accumulated display duration.

Alternatively, a plurality of the estimated adjustment parameters may be notified to the user. For example, the estimated adjustment parameter B2 and B3 which were described above may be notified to the user.

According to this third example of the display apparatus, the emission brightness of the two adjustment elements is adjusted in conjunction such that the predetermined adjustment ratio is maintained. Thus, the emission color of the light emitting groups is adjusted to a desired color easily and with high accuracy, even if the emission color of the light emitting element groups changes non-lineally based on elapsed time as depicted in FIG. 13.

Alternatively, a plurality of third adjustment information corresponding to the plurality of lines 1-8 may be stored in the storage unit 107 in advance. The WB adjustment unit 106 may automatically adjust the emission brightness of the two adjustment elements using at least one of the plurality of the third adjustment information corresponding to the plurality of lines 1-8 depending on the preset accumulated display duration. In that case, user's instruction to adjust the adjustment parameter is not necessary.

The second adjustment information and the third adjustment information may include a value for adjusting the emission color of the light emitting element groups toward the emission color corresponding to zero hour of the accumulated display duration. The second adjustment information and the third adjustment information may only have information corresponding to accumulated display durations.

It is not limited to the example that the first adjustment information and the second adjustment information corresponds to every 250 hours ranges and the adjustment ratio stored in a storage unit 107 corresponds to every 250 hours ranges. If the hour range corresponding to the adjustment ratio is wide, a chromaticity indicated by a line may be off from proper chromaticity point. But, if the difference between a chromaticity indicated by a line and a proper chromaticity point is within a A-level permissible range, the difference is not a problem. Therefore, the hour range corresponding to the adjustment ratio may be determined such that the difference between a chromaticity indicated by a line and a proper chromaticity point is within a A-level permissible range.

Figure 15:
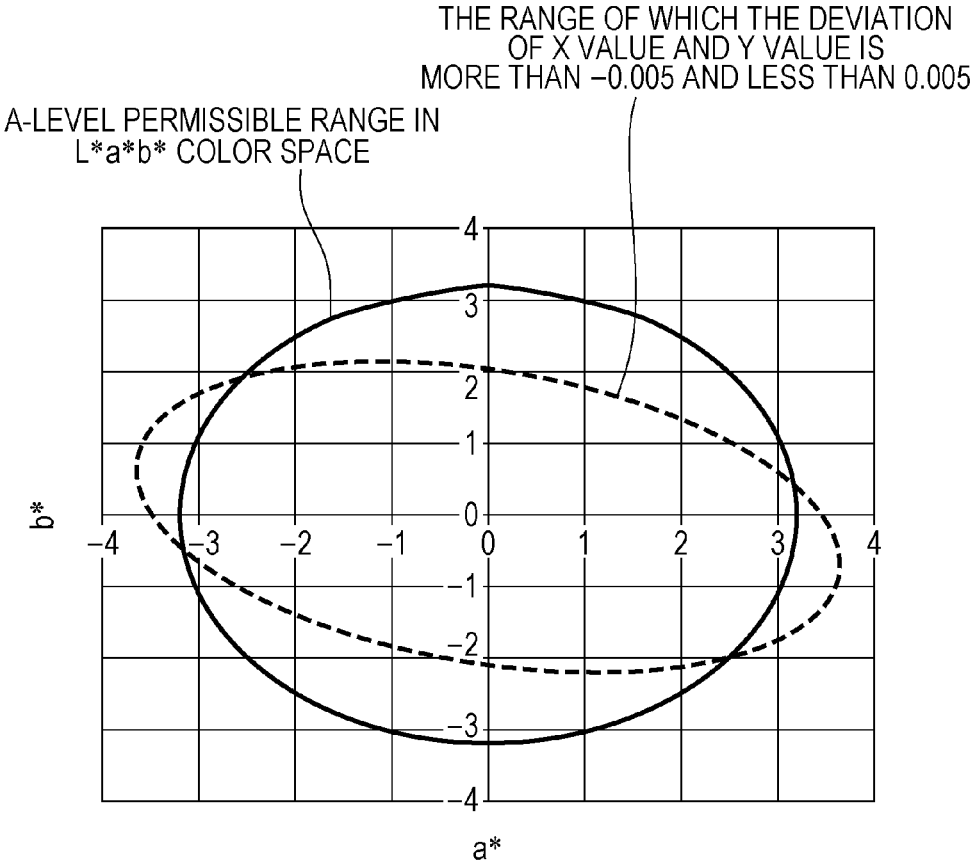
FIG. 15 depicts an example permissible range of the deviation of chromaticity.
Figure 16:
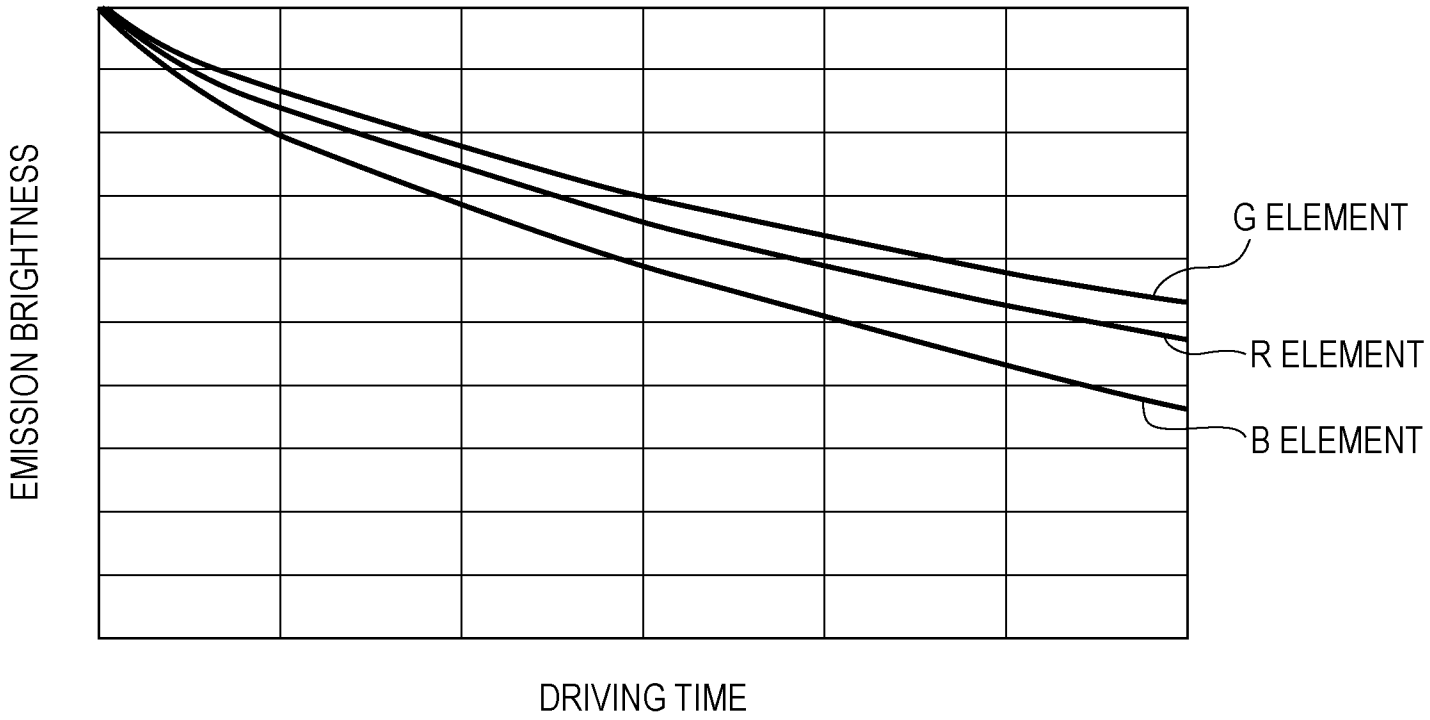
FIG. 16 depicts an example of the temporal change of the emission brightness of R element, G element, and B element each of which is an organic EL element.
Figure 17:
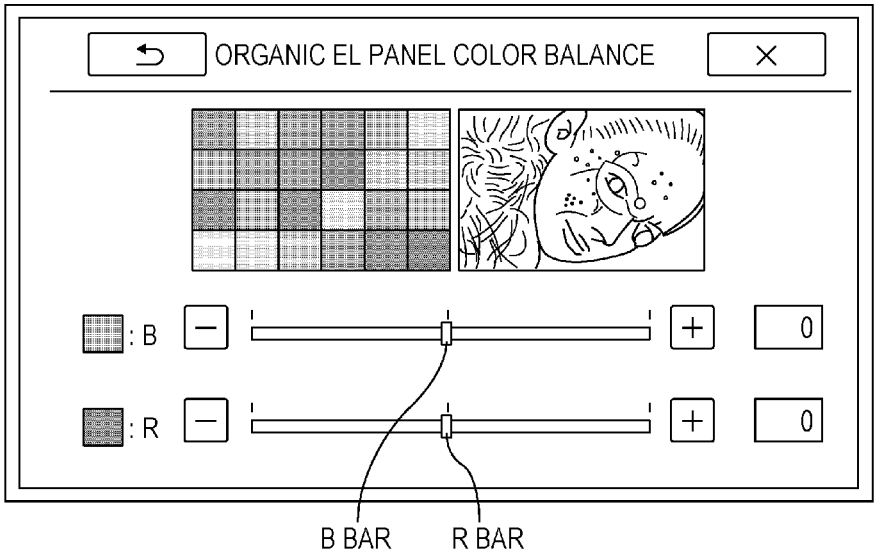
FIG. 17 depicts a prior art parameter adjustment image.

FIG. 15 depicts an example permissible range of the deviation of chromaticity. Referring to FIG. 15, the range of which the difference between a set of X value and Y value indicated by a line and a proper set of X value and Y value is more than −0.005 and less than 0.005 is substantially equal to the A-level permissible range in L*a*b color space. Therefore, the hour range corresponding to the adjustment ratio may be determined such that the difference between a set of X value and Y value indicated by a line and a proper set of X value and Y value is more than −0.005 and less than 0.005.

This invention is not limited to the above examples of the display apparatus. A part or all of each example may be combined with other example.

The sub-pixel values of the adjustment elements may be adjusted using technology that adjusts contrast or gamma value.

Other Embodiments

Embodiment(s) of the present invention can also be realized by a computer of a system or apparatus that reads out and executes computer executable instructions (e.g., one or more programs) recorded on a storage medium (which may also be referred to more fully as a 'non-transitory computer-readable storage medium') to perform the functions of one or more of the above-described embodiment(s) and/or that includes one or more circuits (e.g., application specific integrated circuit (ASIC)) for performing the functions of one or more of the above-described embodiment(s), and by a method performed by the computer of the system or apparatus by, for example, reading out and executing the computer executable instructions from the storage medium to perform the functions of one or more of the above-described embodiment(s) and/or controlling the one or more circuits to perform the functions of one or more of the above-described embodiment(s). The computer may comprise one or more processors (e.g., central processing unit (CPU), micro processing unit (MPU)) and may include a network of separate computers or separate processors to read out and execute the computer executable instructions. The computer executable instructions may be provided to the computer, for example, from a network or the storage medium. The storage medium may include, for example, one or more of a hard disk, a random-access memory (RAM), a read only memory (ROM), a storage of distributed computing systems, an optical disk (such as a compact disc (CD), digital versatile disc (DVD), or Blu-ray Disc (BD)™), a flash memory device, a memory card, and the like.

While the present invention has been described with reference to exemplary embodiments, it is to be understood that the invention is not limited to the disclosed exemplary embodiments. The scope of the following claims is to be accorded the broadest interpretation so as to encompass all such modifications and equivalent structures and functions.

This application claims the benefit of Japanese Patent Application No. 2013-234815, filed Nov. 13, 2013, which is hereby incorporated by reference herein in its entirety.

What is claimed is:

1. A display apparatus comprising:

a light emitting element group composed of three light emitting elements each having a different emission color;

a storage unit configured to store first adjustment information which characterizes correspondence between adjustment parameters which are capable of being set and adjustment amounts of emission brightness of each of two light emitting elements among the three light emitting elements;

a setting unit configured to set an adjustment parameter; and an adjustment unit configured to adjust the emission brightness of the two light emitting elements based on the adjustment parameter set via the setting unit and the first adjustment information stored by the storage unit; and a generation unit configured to generate a graphic image including a user input area which enables a user to designate the adjustment parameter, wherein the setting unit is configured to set the adjustment parameter in response to a user's designation in the user input area.

2. The display apparatus according to claim 1, wherein the setting unit is configured to set one kind of adjustment parameter to adjust the emission brightness of the two light emitting elements simultaneously.

3. The display apparatus according to claim 1, wherein the storage unit is configured to store second adjustment information which characterizes the correspondence between estimated adjustment parameters and accumulated display durations of the display apparatus, and the display apparatus further comprises:

a measurement unit configured to measure an accumulated display duration of the display apparatus, and a estimation unit configured to determine an estimated adjustment parameter corresponding to the accumulated display duration measured by the measurement unit based on the second adjustment information.

4. The display apparatus according to claim 1, wherein the storage unit is configured to store third adjustment information which characterizes the correspondence between accumulated display durations of the display apparatus and adjustment amounts of the emission brightness of the two adjustment elements, the display apparatus further comprises a measurement unit configured to measure an accumulated display duration of the display apparatus, and wherein the adjustment unit is configured to adjust the emission brightness of the two light emitting elements by an adjustment amount corresponding to the accumulated display duration measured by the measurement unit based on the third adjustment information.

5. The display apparatus according to claim 1, wherein the first adjustment information is characterized by a linear function.

6. The display apparatus according to claim 1, wherein the first adjustment information is a data table.

7. The display apparatus according to claim 1, wherein the user input area includes a predetermined image which enables a user to designate the adjustment parameter, and wherein the predetermined image is movable.

8. A control method of a display apparatus comprising a light emitting element group composed of three light emitting elements each having a different emission color, and a storage unit configured to store first adjustment information which characterizes correspondence between adjustment parameters which are capable of being set and adjustment amounts of emission brightness of each of two light emitting elements among the three light emitting elements;

the method comprising steps of:

setting an adjustment parameter;

adjusting the emission brightness of the two light emitting elements based on the adjustment parameter set via the setting step and the first adjustment information stored in the storage unit; and generating a graphic image including a user input area which enables a user to designate the adjustment parameter, wherein the setting step includes setting the adjustment parameter in response to a user's designation in the user input area.

9. The control method of the display apparatus according to claim 8, wherein the setting step includes setting one kind of adjustment parameter to adjust the emission brightness of the two light emitting elements simultaneously.

10. The method of the display apparatus according to claim 8, wherein the storage unit is configured to store second adjustment information which characterizes the correspondence between estimated adjustment parameters and accumulated display durations of the display apparatus, and the method further comprises steps of:

measuring an accumulated display duration of the display apparatus, and determining an estimated adjustment parameter corresponding to the accumulated display duration measured in the measuring step based on the second adjustment information.

11. The method of the display apparatus according to claim 8, wherein the storage unit is configured to store third adjustment information which characterizes the correspondence between accumulated display durations of the display apparatus and adjustment amounts of the emission brightness of the two adjustment elements, the method further comprises a step of measuring an accumulated display duration of the display apparatus, and wherein the adjusting step includes adjusting the emission brightness of the two light emitting elements by an adjustment amount corresponding to the accumulated display duration measured in the measuring step based on the third adjustment information.

12. The method of the display apparatus according to claim 8, wherein the first adjustment information is characterized by a linear function.

13. The method of the display apparatus according to claim 8, wherein the first adjustment information is a data table.

14. The method of the display apparatus according to claim 8, wherein the user input area includes a predetermined image which enables a user to designate the adjustment parameter, and wherein the predetermined image is movable.

15. A non-transitory computer-readable storage medium storing a computer-executable program for implementing a method according to claim 8.

16. A light emitting apparatus comprising:

a light emitting element group composed of three light emitting elements each having a different emission color;

a storage unit configured to store first adjustment information which characterizes correspondence between adjustment parameters which are capable of being set and adjustment amounts of emission brightness of each of two light emitting elements among the three light emitting elements;

a setting unit configured to set an adjustment parameter; and an adjustment unit configured to adjust the emission brightness of the two light emitting elements based on the adjustment parameter set via the setting unit and the first adjustment information stored by the storage unit; and a generation unit configured to generate a graphic image including a user input area which enables a user to designate the adjustment parameter, wherein the setting unit is configured to set the adjustment parameter in response to a user's designation in the user input are.

17. The display apparatus according to claim 1, wherein the three light emitting elements are a red light emitting element, a green light emitting element and a blue light emitting element, and the two light emitting elements are the red light emitting element and the blue light emitting element.

18. The control method of the display apparatus according to claim 8, wherein the three light emitting elements are a red light emitting element, a green light emitting element and a blue light emitting element, and the two light emitting elements are the red light emitting element and the blue light emitting element.

* * * * *